United States Patent [19]

Izumi et al.

[11] Patent Number: 4,945,723

[45] Date of Patent: Aug. 7, 1990

[54] FLOW CONTROL VALVES FOR HYDRAULIC MOTOR SYSTEM

[75] Inventors: Eiki Izumi, Ibaragi; Toichi Hirata, Ushiku; Yusaku Nozawa, Ibaragi; Masahiko Shimotori, Nagareyama, all of Japan

[73] Assignee: Hitachi Construction Machinery Co., Ltd., Tokyo, Japan

[21] Appl. No.: 213,179

[22] Filed: Jun. 29, 1988

[30] Foreign Application Priority Data

Jun. 30, 1987 [JP] Japan ..... 62-162703
Sep. 21, 1987 [JP] Japan ..... 62-234992

[51] Int. Cl.[5] ..... F15B 11/16

[52] U.S. Cl. ..... 60/426; 60/464; 137/596.14; 91/517; 91/518; 91/531

[58] Field of Search ..... 91/448, 461, 517, 518, 91/531, 532; 60/426, 464; 137/596.14, 596.16; 251/35

[56] References Cited

U.S. PATENT DOCUMENTS

| | | | |
|---|---|---|---|
| 2,565,242 | 8/1951 | Lane | 91/417 R |
| 3,996,840 | 12/1976 | Futamata et al. | 91/461 X |
| 4,362,018 | 12/1982 | Torii | 60/468 |
| 4,383,412 | 5/1983 | Presley | 60/430 |
| 4,425,759 | 1/1984 | Krusche | 60/420 |
| 4,437,385 | 3/1984 | Kramer et al. | 91/448 X |
| 4,535,809 | 8/1985 | Andersson | 137/596.14 |
| 4,617,854 | 10/1986 | Kropp | 91/517 |
| 4,662,601 | 5/1987 | Andersson | 251/35 |
| 4,712,376 | 12/1987 | Hadank et al. | 60/427 |

FOREIGN PATENT DOCUMENTS

| | | |
|---|---|---|
| 409734 | 4/1969 | Australia . |
| 0235545 | 9/1987 | European Pat. Off. . |
| 0262098 | 3/1988 | European Pat. Off. . |
| 222601 | 11/1985 | Japan . |
| 250131 | 12/1985 | Japan . |
| 1078908 | 8/1967 | United Kingdom . |

*Primary Examiner*—Robert E. Garrett
*Assistant Examiner*—George Kapsalas
*Attorney, Agent, or Firm*—Fay, Sharpe, Beall, Fagan, Minnich & McKee

[57] ABSTRACT

A hydraulic drive system has first and second flow control valves. Each of the control valves has a main valve of the seat valve type with a valve body for controlling communication between an inlet port and an outlet port which are both connected to a main circuit. Each further have a variable restrictor capable of changing an opening degree thereof in response to displacements of the valve body, and a back pressure chamber communcating with the inlet port through the variable restrictor and producing a control pressure to urge the valve body in the valve-closing direction. A pilot valve is connected to a pilot circuit which is connected between the back pressure chamber and the outlet port of the main valve; and an auxiliary valve is connected to the pilot circuit for controlling a differential pressure between the inlet pressure and the outlet pressure of the pilot valve. The auxiliary valve is controlled such that the differential pressure between the inlet pressure and the outlet pressure of the pilot valve has a relationship expressed by a certain equation including constants $\alpha$, $\beta$ and $\gamma$, with respect to a differential pressure between the delivery pressure of a hydraulic pump and the maximum load pressure of the first and second hydraulic actuators, a differential pressure between that maximum load pressure and the self-load pressure of each of the hydraulic actuators, and the self-load pressure, wherein the constants $\alpha$, $\beta$ and $\gamma$ are set to respective predetermined values.

19 Claims, 20 Drawing Sheets

FLOW CONTROL VALVES FOR HYDRAULIC MOTOR SYSTEM

BACKGROUND OF THE INVENTION

The present invention relates to a hydraulic drive system for hydraulic construction machines, such as hydraulic excavators and hydraulic cranes, each equipped with a plurality of hydraulic actuators, and more particularly to a hydraulic drive system for controlling a flow rate of hydraulic fluid supplied to the hydraulic actuators using flow control valves each having a pressure compensating function.

Heretofore, a hydraulic drive system for hydraulic construction machines, such as hydraulic excavators and hydraulic cranes, each equipped with a plurality of hydraulic actuators generally comprises at least one hydraulic pump, a plurality of hydraulic actuators connected to the hydraulic pump through respective main circuits and driven by hydraulic fluid delivered from the hydraulic pump, and a plurality of flow control valves connected to the respective main circuits between the hydraulic pump and the respective hydraulic actuators.

U.S. Pat. No. 4,617,854 discloses a hydraulic drive system of the type having an auxiliary valve disposed in the main circuit upstream of each flow control valve. The inlet and outlet pressures of the flow control valve are both introduced to the first one of opposite operating parts of the auxiliary valve. The delivery pressure of the hydraulic pump and the maximum load pressure among a plurality of hydraulic actuators are both introduced to a second one of the opposite operating parts thereof, and a pump regulator of load sensing type is disposed to hold the delivery pressure of the hydraulic pump at a predetermined value higher than that maximum load pressure. In this arrangement, by introducing the inlet and outlet pressures of the flow control valve to the first one of the opposite operating parts of the auxiliary valve, the load pressure of the flow control valve is compensated as known in the art. Also, by introducing the delivery pressure of the hydraulic pump, regulated by the pump regulator and the maximum load pressure among the plurality of hydraulic actuators, to the second one of the opposite operating parts of the auxiliary valve, in the combined operation of the plurality of hydraulic actuators having respective load pressures different from each other, it is made possible that even if the total of commanded flow rates (required flow rates) of the respective hydraulic actuators exceeds a maximum delivery flow rate of the hydraulic pump, the delivery rate of the hydraulic pump is distributed in accordance with relative ratios of the commanded flow rates to thereby ensure that hydraulic fluid is reliably passed to the hydraulic actuators on the side of higher load pressure as well.

On the other hand, U.S. Pat. No. 4,535,809 discloses a hydraulic drive system directed not to a plurality but to a single hydraulic actuator. In this hydraulic drive system, each flow control valve connected to a main circuit between a hydraulic pump and a hydraulic actuator is constituted by a combination of a main valve of seat valve type, and a pilot valve connected to a pilot circuit between a back pressure chamber of the main valve and an output port. An auxiliary valve is also disposed in the pilot circuit, and the input and output pressures of the pilot valve are introduced to opposite operating parts of the auxiliary valve, respectively, for providing a pressure compensating function. This patent further discloses a modification in which the self-load pressure is used to affect operation of the single hydraulic actuator for correction of the pressure compensating function.

In U.S. Pat. No. 4,617,854, however, the flow control valve and the auxiliary valve each comprise a spool valve which is relatively large in size, as they are both disposed in the main circuit. Accordingly, if the hydraulic circuit is subject to higher pressure for energy savings, this gives rise to the problem of causing appreciable fluid leakage from those spool valves. Also, since the auxiliary valve is disposed in the main circuit through which a large flow rate passes, there is a suffering from another problem of increasing pressure loss at the auxiliary valve.

Generally speaking, each hydraulic actuator in the hydraulic drive system preferably should be supplied with a corresponding flow rate free of any effects from self-load pressure and respective load pressures of other hydraulic actuators. Meanwhile, in some cases, it may be preferable for hydraulic drive systems employed in construction machines such as hydraulic excavators to be affected by load pressures of any other hydraulic actuators or self-load pressure depending on the types of working members and the working modes thereof to be driven by the relevant hydraulic actuator.

For example, when a hydraulic excavator is used for loading earth onto a truck by carrying out swing and boom-up operations concurrently, the load pressure of a swing motor becomes high at the beginning of the swing operation and exceeds the limit pressure of a relief valve provided for circuit protection, because a swing body is of an inertial body. To the contrary, the boom load pressure which represents a boom holding pressure is lower than the swing load pressure. In such working mode, if hydraulic fluid is supplied to the boom to the extent possible rather than being relieved during the time the swing load pressure remains higher at the beginning of the swing operation, energy will be less wasted, and the boom-up and swing operations can automatically be adjusted in their speeds such that the boom-up speed is increased faster than the swing speed at the beginning and, after the boom has been raised up to some extent, the swing speed is gradually increased.

Similarly, in the sole swing operation or the combined swing operation with other hydraulic actuators, the swing load pressure exceeds the limit pressure of a relief valve at the beginning of the swing as mentioned above. Thus, energy will be less wasted provided that the amount of hydraulic fluid supplied to the swing motor can be reduced with the increasing swing load pressure.

In some working modes of a hydraulic excavator, such as normal surface make-up working effected by the combined operation of boom and arm thereof, it is desired to accurately distribute the flow rate in response to the ratio of operated amounts of a boom control lever to an arm control lever irrespective of the magnitude of load pressures.

Therefore, construction machines such as hydraulic excavators desirably have characteristics of the flow control valve which are not determined uniquely for specific pressure compensating and/or flow distributing function, but can be modified to flexibly provide various functions depending on the types of working members and the working modes thereof driven by respective hydraulic actuators.

In U.S. Pat. No. 4,617,854, however, while a pressure compensating function and a flow distributing function can be obtained by provision of the auxiliary valve as mentioned above, there is disclosed no idea of introducing effects from load pressures of other hydraulic actuators or self-load pressure in order to modify those functions. Thus, this patent could not meet the above demand of modifying characteristics of the flow control valve depending on the types of and forms of the working members.

As per U.S. Pat. No. 4,535,809, since it discloses a hydraulic drive system directed to a single hydraulic actuator, provision of the auxiliary valve merely enables it to perform a pressure compensating function in connection with operation of the single hydraulic actuator, or to modify the pressure compensating function by introducing an effect of the self-load pressure of the single hydraulic actuator. Thus, this patent has no relation to the technique of modifying various functions in the combined operation of a plurality of hydraulic actuators. In particular, there is disclosed no idea of introducing effects of load pressures of other hydraulic actuators to modfy the pressure compensating function and the flow distributing function.

It is an object of the present invention to provide a hydraulic drive system which is less subject to a fluid leakage and pressure loss, and which can modify characteristics of a flow control valve depending on the types of working member of hydraulic construction machines and the working modes thereof.

SUMMARY OF THE INVENTION

To achieve the above object, the present invention provides a hydraulic drive system comprising: at least one hydraulic pump; at least first and second hydraulic actuators connected to the hydraulic pump through respective main circuits and driven by hydraulic fluid delivered from the hydraulic pump; first and second flow control valve means connected to the respective main circuits between the hydraulic pump and the first and second hydraulic actuators: pump control means for controlling a delivery pressure of the hydraulic pump; each of the first and second flow control valve means comprising first valve means having an opening degree variable in response to the operated amount of operation means, and second valve means connected in series with the first valve means for controlling a differential pressure between the inlet pressure and the output pressure of the first valve means; and control means associated with each of the first and second flow control valve means for controlling the second valve means based on the input pressure and the output pressure of the first valve means, the delivery pressure of the hydraulic pump, and the maximum load pressure between the first and second hydraulic actuators. Each of the first and second flow control valve means comprises; a main valve of seat valve type having a valve body for controlling communication between an inlet port and an outlet port both connected to the main circuit, a variable restrictor capable of changing an opening degree thereof in response to displacements of the valve body, and a back pressure chamber communicating with the inlet port through the variable restrictor and producing a control pressure to urge the valve body in the valve-closing direction; and a pilot circuit connected between the back pressure chamber and the outlet port of the main valve. The first valve means is constituted by a pilot valve connected to the pilot circuit for controlling a pilot flow passing through the pilot circuit. The second valve means is constituted by auxiliary valve means connected to the pilot circuit for controlling a differential pressure between the inlet pressure and the outlet pressure of the pilot valve. The control means controls the auxiliary valve means for each of the first and second flow control valve means such that the differential pressure between the inlet pressure and the outlet pressure of the pilot valve has a relationship as expressed by the following equation with respect to a differential pressure between the delivery pressure of the hydraulic pump and the maximum load pressure of the first and second hydraulic actuators, a differential pressure between the maximum load pressure and the self-load pressure of each of the hydraulic actuators, and the self-load pressure, $$\Delta Pz=\alpha(Ps-Pl\max)+\beta(Pl\max-Pl)+\gamma Pl$$

where

- $\Delta Pz$: differential pressure between the inlet pressure and the outlet pressure of the pilot valve
- Ps: delivery pressure of the hydraulic pump
- Pl max: maximum load pressure between the first and second hydraulic actuators
- Pl: self-load pressure of each of the first and second hydraulic actuators
- $\alpha,\beta,\gamma$: first, second and third constants the first, second and third constants $\alpha,\beta,\gamma$ being set to respective predetermined values.

As a result of studying relationships between the auxiliary valve disposed in the pilot circuit and the differential pressure across the pilot valve from various viewpoints, the present inventors have found that the differential pressure $\Delta Pz$ across the pilot valve controlled by the auxiliary valve means is generally expressed by the foregoing equation.

The equation has the meaning as follows. In that equation, the first term Ps−Plmax in the right side is common to all of the flow control valves and hence governs a flow distributing function in the combined operation. The second term Plmax−Pl is changed depending on the maximum load pressure among other actuators and hence governs a harmonizing function in the combined operation. The third term $\gamma$Pl is changed depending on the self-load pressure and hence governs a self-pressure compensating function. Actuation or non-actuation and the degree of these three functions are determined depending on respective values of the constants $\alpha,\beta,\gamma$. More specifically, the flow distributing function represented by the first term is an essential basic function for the combined operation. Therefore, the constant $\alpha$ is set to a predetermined positive value irrespective of the types of associated working members. On the contrary, the harmonizing function and the self-pressure compensating function respectively represented by the second and third terms are additional functions effected depending on the types of associated working members and the working modes thereof. Therefore, the constants $\beta,\gamma$ are each set to a predetermined value including zero. By so setting $\alpha,\beta,\gamma$, it becomes possible to provide the flow distributing function, or the harmonizing function and/or the self-pressure compensating function based on the flow distributing function, thereby enabling modification of characteristics of the flow control valves depending on the types of working members of hydraulic construction machines and the working modes thereof.

In the above arrangement of the present invention, the auxiliary valves are installed in not the main circuits but the pilot circuits, and the main valves installed in the main circuits are constituted in the form of seat valves. This makes it possible to provide the hydraulic circuit which is less susceptible to fluid leakage and suitable for higher pressurization. With the auxiliary valves disposed in the pilot circuits, appreciable pressure loss will not occur at the auxiliary valves even if a large flow rate is passed through the main circuits.

In the present invention, the first constant $\alpha$ preferably meets a relationship of $\alpha \leqq K$, assuming that K is a ratio of the pressure receiving area of the valve body of the main valve, which undergoes the delivery pressure of the hydraulic pump through the inlet port, to the pressure receiving area of the valve body of the main valve, which undergoes the control pressure of the back pressure chamber. This limits the differential pressure determined by $\alpha(Ps-Plmax)$ within the maximum differential pressure available across the pilot valve on the side of higher load pressure. Thus, the first and second flow control valves have their differential pressures given by the first term in the right side of the above equation substantially equal to each other, so that the flow rate can accurately be distributed in proportion to the operated amounts of the operation means (i.e., opening degrees of the pilot valves) in the fluid distributing function.

The first constant $\alpha$ has the meaning of a proportional gain of the pilot flow rate with respect to the operated amount of the operation means (i.e., opening degree of the pilot valve), namely a proportional gain of the flow rate passing through the main valve with respect to that operated amount. Thus, the first constant $\alpha$ is set to any desired positive value corresponding to the proportional gain. Where $\alpha=K$ is set, the maximum proportional gain can be provided while attaining the fluid distributing function to distribute the flow rate in proportion to the operated amounts of the operation means.

As will be apparent from the following description, the second constant $\beta$ is set to any desired value taking into account harmonization in the combined operation of the associated hydraulic actuator and one or more other hydraulic actuators. In particular, where it is preferable not to accept any effects from load pressures of other hydraulic actuators, $\beta$ is set equal to zero.

Also as will be apparent from the following description, the third constant $\gamma$ is set to any desired value taking into account operating characteristics of the associated hydraulic actuator. In particular, where it is preferable not to accept any effect of the self-load pressure, $\gamma$ is also set equal to zero.

The control means may have a plurality of hydraulic control chambers provided in each of the auxiliary valve for the first and second flow control valve means, and line means for directly or indirectly introducing the delivery pressure of the hydraulic pump, the maximum load pressure, and the inlet pressure and the outlet pressure of the pilot valve to the plurality of hydraulic control chambers. In this case, the respective pressure receiving areas of the plurality of hydraulic control chambers are set such that the first, second and third constants $\alpha,\beta,\gamma$ take the respective predetermined values.

As an example of constituting the control means in a hydraulic manner, the auxiliary valve is disposed between the back pressure chamber of the main valve and the pilot valve, the plurality of hydraulic control chambers comprise a first hydraulic control chamber for urging the auxiliary valve in the valve-opening direction, and second, third and fourth hydraulic control chambers for urging the auxiliary valve in the valve-closing direction, and the line means comprises a first line for introducing the control pressure in the back pressure of the main valve to the first hydraulic chamber, a second line for introducing the inlet pressure of the pilot valve to the second hydraulic control chamber, a third line for introducing the maximum load pressure to the third hydraulic control chamber, and a fourth line for introducing the delivery pressure of the hydraulic pump to the fourth hydraulic control chamber.

With the control means thus arranged, the first and second flow control valves can each be constituted by incorporating the main valve and the auxiliary valve into an integral structure. This provides a compact and rational valve structure.

Furthermore, the control means may comprise electromagnetic operating parts provided in each of the auxiliary valve means for the first and second flow control valves, pressure detector means for directly or indirectly detecting the delivery pressure of the hydraulic pump, the maximum load pressure, and the inlet pressure and the outlet pressure of the pilot valve, and processing means for calculating a differential pressure between the inlet pressure and the outlet pressure of the pilot valve based on detected signals from the pressure detector means, and then outputting a calculated differential pressure signal to the electromagnetic operating parts of the auxiliary valve means. In this case, the first, second and third constants $\alpha,\beta,\gamma$ are preset as the respective predetermined values in the processing means.

The pump control means can be a pump regulator of load sensing type for holding the delivery pressure of the hydraulic pump at a predetermined value higher than the maximum load pressure between the first and second hydraulic actuators. With this feature, inasmuch as the pump regulator is effectively operating, the differential pressure $Ps-Plmax$, determined by the first term of the right side in the above equation, between the delivery pressure and the maximum load pressure among the plurality of hydraulic actuators is held at a constant level. Therefore, the differential pressure between the inlet pressure and the outlet pressure of the pilot valve can be controlled to remain constant, thereby effecting the pressure compensating function with which the flow rate is maintained at a constant irrespective of changes in the differential pressure between the inlet and outlet ports of the main valve.

To achieve the above-mentioned object, the present invention also provides a hydraulic excavator comprising; at least one hydraulic pump; a plurality of hydraulic actuators connected to the hydraulic pump through respective main circuits and driven by hydraulic fluid delivered from the hydraulic pump; a plurality of working members including a swing body, boom, arm and bucket, and driven by the plurality of hydraulic actuators, respectively; a plurality of flow control valve means connected to the respective main circuits between the hydraulic pump and the plurality of hydraulic actuators; pump control means for controlling a delivery pressure of the hydraulic pump; each of the plurality of flow control valve means comprising first valve means having an opening degree variable in response to the operated amount of operation means, and second valve means connected in series with the first valve means for controlling a differential pressure between the inlet pressure and the output pressure of the first valve means; and control means associated with each of the plurality of flow control valve means for controlling the second valve means based on the input pressure and the output pressure of the first valve means, the delivery pressure of the hydraulic pump, and the maximum load pressure among the plurality of hydraulic actuators. Each of the plurality of flow control valve means comprises; a main valve of seat valve type having a valve body for controlling communication between an inlet port and an outlet port both connected to the main circuit, a variable restrictor capable of changing an opening degree thereof in response to displacements of the valve body, and a back pressure chamber communicating with the inlet port through the variable restrictor and producing a control pressure to urge the valve body in the valve-closing direction; and a pilot circuit connected between the back pressure chamber and the outlet port of the main valve. The first valve means is constituted by a pilot valve connected to the pilot circuit for controlling a pilot flow passing through the pilot circuit. The second valve means is constituted by auxiliary valve means connected to the pilot circuit for controlling a differential pressure between the inlet pressure and the outlet pressure of the pilot valve. The control means controls the auxiliary valve means for each of the plurality of flow control valve means associated with at least two working members among the swing body, boom, arm and bucket such that the differential pressure between the inlet pressure and the outlet pressure of the pilot valve has a relationship expressed by the following equation with respect to a differential pressure between the delivery pressure of the hydraulic pump and the maximum load pressure among the plurality of hydraulic actuators, a differential pressure between the maximum load pressure and the self-load pressure of each of the hydraulic actuators, and the self-load pressure, $$Pz-Pl=\alpha(Ps-Plmax)+\beta(Plmax-Pl)+\gamma Pl$$

where

Pz: inlet pressure of the pilot valve

Pl: outlet pressure of the pilot valve

Ps: delivery pressure of the hydraulic pump

Plmax: maximum load pressure among the plurality of hydraulic actuators

Pl: self-load pressure of each of the plurality of hydraulic actuators $\alpha,\beta,\gamma$: first, second and third constants the first, second and third constants $\alpha,\beta,\gamma$ being set to respective predetermined values.

According to the present invention thus arranged, characteristics of the flow control valves associated with at least two working members among the swing body, boom, arm and bucket can be set and modified depending on the types of working members and the working modes thereof. Thus, it becomes possible to attain the flow distributing function, or the harmonizing function and/or the self-pressure compensating function based on the flow distributing function, as mentioned above.

Preferably, the control means sets the second constant $\beta$ to a relatively large positive value for the flow control valve means associated with the bottom side of the hydraulic actuator for the boom.

By so setting, at the initial accelerating stage in the combined swing and boom-up operation, the flow rate corresponding to an increase in the differential pressure between the maximum load pressure (swing pressure) and the self-load pressure (boom pressure) is passed through the bottom side flow control valve of the hydraulic actuator for the boom on the lower load side, thereby enabling to increase the boom-up speed. Thus, even when both the swing and boom-up control levers are operated to their full strokes concurrently, there can automatically be obtained the combined operation that the boom-up speed is increased faster than the swing speed at the beginning and, after the boom has been raised up to some extent, the swing speed is increased gradually. Then, reaching the maximum speed, the swing speed remains substantially constant.

Preferably, the control means sets the second constant $\beta$ to a relatively small positive value for the flow control valve means associated with the bottom side of the hydraulic actuator for the arm. By so setting, when the combined operation using the arm is carried out for excavation, the arm is driven reliably. In addition, when the the hydraulic actuator for the arm is on the lower pressure side, the opening degree of the associated flow control valve is enlarged in response to an increase in the differential pressure between the maximum load pressure (any one pressure of other hydraulic actuators) and the self-load pressure (arm pressure), thereby reducing the degree of restricting the flow rate. As a result, it is possible to prevent deterioration of fuel economy and heat balance.

Preferably, the control means sets the second constant $\beta$ to a relatively small negative value for the flow control valve means associated with the bottom side of the hydraulic actuator for the bucket. By so setting, when the combined operation using the bucket is carried out for digging grooves, the flow rate passing through the associated flow control valve is reduced upon an increase in the differential pressure between the maximum load pressure (any one pressure of other hydraulic actuators) and the self-load pressure (bucket pressure), at the moment the bucket is released from the digging load and comes up to the ground surface, thereby enabling to mitigate shocks.

Preferably, the control means sets the third constant $\gamma$ to a relatively small negative value for the flow control valve means associated with the hydraulic actuator for the swing body. By so setting, during the swing acceleration, the flow rate passing through the flow control valve associated with the swing can be reduced in response to an increase in the swing pressure (self-load pressure). Thus, the flow rate discharged through the relief valve is also reduced to save energy consumption.

Preferably, the control means sets the third constant $\gamma$ to a relatively small positive value for the flow control valve means associated with the hydraulic actuator for the bucket. By so setting, when the bucket is used for excavation, the flow rate passing through the associated flow control valve can be increased in response to an increase in the bucket pressure (self-load pressure), thereby providing powerful feeling in the excavating work.

Preferably, the control means sets the second and third constants $\beta,\gamma$ to zero for the flow control valve means associated with the rod side of the hydraulic actuators for the boom and the arm. By so setting, when the boom and the arm are used for building up the normal surface of a ramp, any effects from the load pressures of other hydraulic actuators and the self-load pressure is eliminated completely, so that the flow rate can accurately be distributed in proportion to the operated amounts of the boom and arm control levers for making-up of the desired accurate normal surface.

DETAILED DESCRIPTION OF THE PREFERRED EMBODIMENTS

Preferred embodiments of the present invention will be described below with reference to the drawings.

BASIC EMBODIMENT

Figure 1:
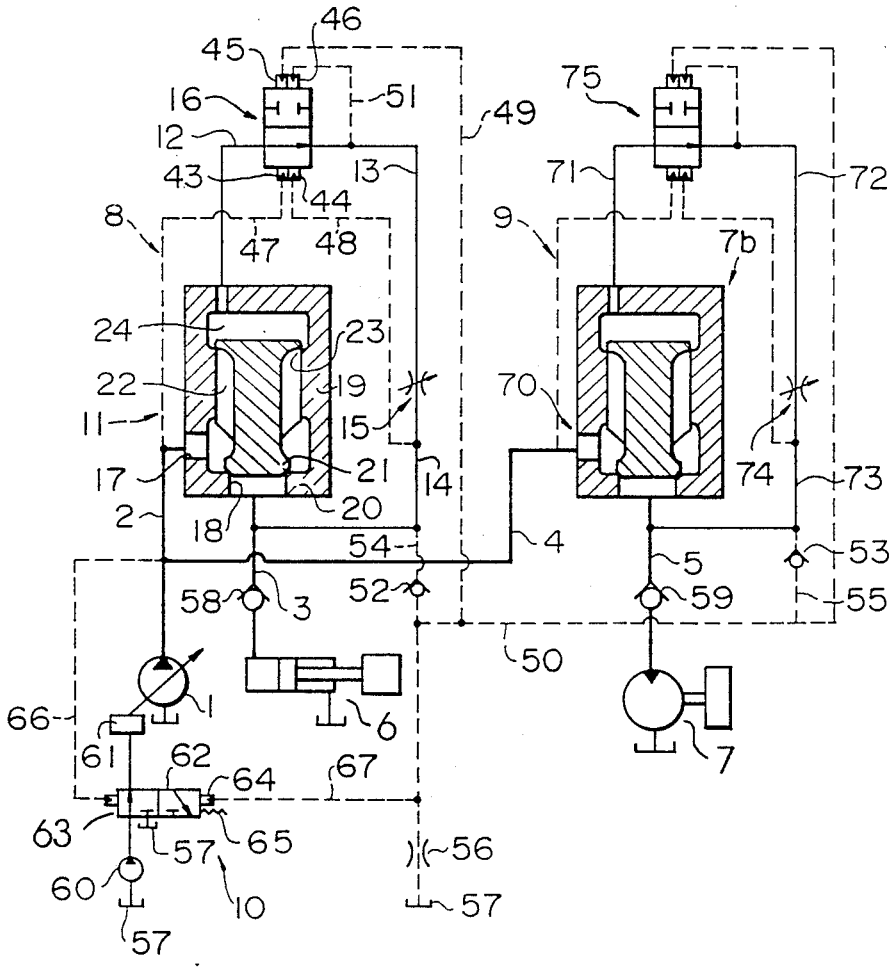
FIG. 1 is a schematic view showing an overall arrangement of a hydraulic drive system according to one embodiment of the present invention.

Referring to FIG. 1, a hydraulic drive system according to one embodiment of the present invention comprises a variable delivery hydraulic pump 1 of swash plate type, for example, a plurality of hydraulic actuators 6, 7 connected to the hydraulic pump 1 through main lines 2, 3 and 4, 5 which serve as main circuits, respectively, and driven by hydraulic fluid delivered from the hydraulic pump 1, and flow control valves 8, 9 connected to the main lines 2, 3 and 4, 5 between the hydraulic pump 1 and the hydraulic actuators 6, 7, respectively. The hydraulic pump 1 is associated with a pump regulator 10 of load sensing type which serves to hold a delivery pressure of the hydraulic pump 1 higher a predetermined value than a maximum load pressure among the plurality of hydraulic actuators 6, 7.

The flow control valve 8 comprises a main valve 11 connected to the main lines 2, 3 between the hydraulic pump 1 and the hydraulic actuator 6, pilot lines 12, 13, 14 jointly constituting a pilot circuit for the main valve 11, a pilot valve 15 connected to the pilot lines 13, 14, and a pressure compensating valve 16, as an auxiliary valve, connected to the pilot lines 12, 13 in series with the pilot valve 15.

The main valve 11 comprises a valve housing 19 having an inlet port 17 and an output port 18 connected to the main lines 2, 3, respectively, and a valve body 21 disposed in the valve housing 19 and engageable with a valve seat 20, to thereby control communication between the inlet port 17 and the outlet port 18 in response to displacements (i.e., opening degrees) of the valve body 21 with respect to the valve seat 20. The valve body 21 has formed in its outer circumference a plurality of axial slits 22, the slits 22 being cooperable with the inner wall of the valve housing 19 to constitute a variable restrictor 23 which has a variable opening degree in response to displacements of the valve body 21. At the back of the valve body 21 within the valve housing 19, there is formed a back pressure chamber 24 communicating with the inlet port 17 through the variable restrictor 23 and producing a control pressure Pc.

Figure 2:
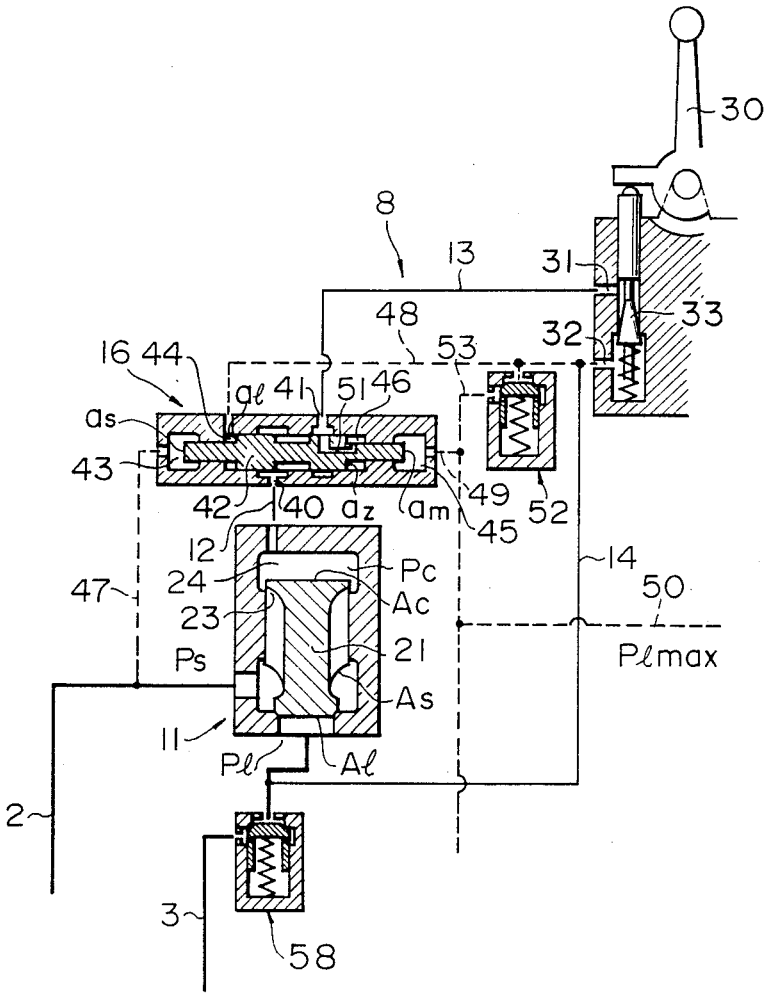
FIG. 2 is a sectional view showing the structure of a flow control valve of the hydraulic drive system.

As shown in FIG. 2, the upper annular end surface (as viewed on the drawing sheet) of the valve body 21 facing the inlet port 17 defines an annular pressure receiving area As which receives the delivery pressure Ps of the hydraulic pump 1, the bottom wall surface of the valve body 21 facing the output port 18 defines a pressure receiving area Al which receives a load pressure Pl of the hydraulic actuator 6, and the top end surface of the valve body 21 facing the back pressure chamber 24 defines a pressure receiving area Ac which receives a control pressure Pc. Among these pressure receiving areas, there exists the relationship of $Ac=As+Al$.

In the pilot circuit, the pilot line 12 is connected to the back pressure chamber 24 of the main valve 11, and the pilot line 14 is connected to the outlet port 18 of the main valve.

As shown in FIG. 2, the pilot valve comprises a control lever 30, and a valve body 33 of needle type driven by the control lever 30 for controlling communication between an inlet port 31 connected to the pilot line 13 and an outlet port 32 connected to the pilot line 14.

The pressure compensating valve 16 comprises a valve body 42 of spool type for controlling communication between an inlet port 40 connected to the pilot line 12 and an oulet port 41 connected to the pilot line 13, first and second hydraulic control chambers 43, 44 for urging the valve body 42 in the valve-opening direction, and third and fourth hydraulic chambers 45, 46 positioned in opposite relation to the first and second hydraulic control chambers 43, 44 for urging the valve body 42 in the valve-closing direction. The first hydraulic control chamber 43 is connected to the main line 2 through a pilot line 47, the second hydraulic control chamber 44 is connected to the pilot line 14, i.e., the outlet side of the pilot valve 15, through a pilot line 48, the third hydraulic control chamber 45 is connected to a maximum load pressure line 50 (described later on) through a pilot line 49, and the fourth hydraulic control chamber 46 is connected to the pilot line 13, i.e., the inlet side of the pilot valve 15, through a pilot line 51. Incidentally, the pilot line 51 is formed as an inner passage of the valve body 42. With the above arrangement, the delivery pressure Ps of the hydraulic pump 1 is introduced to the first hydraulic control chamber 43, the outlet pressure Pl of the pilot valve 15 is introduced to the second hydraulic chamber 44, the inlet pressure Pz of the pilot valve 15 is introduced to the third hydraulic control chamber 45, and the load pressure of either hydraulic actuator 6 or 7 on the higher pressure side, i.e., the maximum load pressure Pl is introduced to the fourth hydraulic control chamber 46. Then, the end surface of the valve body 42 facing the first hydraulic control chamber 43 defines a pressure receiving area as which receives the delivery pressure Ps of the hydraulic pump 1, the annular end surface thereof facing the second hydraulic control chamber 44 defines a pressure receiving area al which receives the outlet pressure Pl of the pilot valve 15, the end surface thereof facing the third hydraulic control chamber 45 defines a pressure receiving area am which receives the load pressure of either hydraulic actuator 6 or 7 on the higher pressure side, i.e., the maximum load pressure Plmax, and the annular end surface thereof facing the fourth hydraulic control chamber 46 defines a pressure receiving area az which receives the inlet pressure Pz of the pilot valve 15.

The first through fourth hydraulic control chambers 43–46 and the pilot lines 47–49, 51 thus arranged jointly constitute control means for controlling the auxiliary valve 16 such that the differential pressure $\Delta Pz(=Pz-Pl)$ between the inlet pressure and the outlet pressure of the pilot valve 15 has a relationship expressed by the following equation with respect to a differential pressure Ps−Plmax between the delivery pressure of the hydraulic pump 1 and the maximum load pressure between the two hydraulic actuators 6, 7, a differential pressure Plmax−Pl between the maximum load pressure and the self-load pressure of each hydraulic actuator, and the self-load pressure;

$$\Delta Pz=\alpha(Ps-Plmax)+\beta(Plmax-Pl)+\gamma Pl \quad (1)$$

where $\alpha,\beta,\gamma$ are first, second and third constants and set to respective predetermined values. In this embodiment, setting of the first, second and third constants $\alpha,\beta,\gamma$ to the respective predetermined values is made by properly selecting the pressure receiving areas as, al, am, az of the first through fourth hydraulic control chambers 43–46. In other words, the pressure receiving areas as, al, am, az of the first through fourth hydraulic control chambers 43–46 are so set as to obtain the respective predetermined values of the first, second and third constants $\alpha,\beta,\gamma$. Further, the pressure receiving areas as, al, am, az of the first through fourth hydraulic control chambers 43–46 are set such that the valve body 42 is held at its open position so long as the main valve 11 and the pilot valve 15 are being closed.

In connection with the flow control valve 8 thus arranged, the combination of the main valve 11 of seat valve type and the pilot valve 15 is known from U.S. Pat. No. 4,535,809. As described in this patent, when the control lever 30 of the pilot valve 15 is operated, a pilot flow is formed in the pilot circuit 12–14 in response to the opening degree of the pilot valve 15. Then, under the action of the variable restrictor 23 and the back pressure chamber 24, the valve body 21 of the main valve is opened to the opening degree proportional to the pilot flow rate, so that the flow rate corresponding to the operated amount of the control lever 30 (i.e., opening degree of the pilot valve 15) is passed from the inlet port 17 to the outlet port 18 through the main valve 11.

The flow control valve 9 is constructed similarly to the flow control valve 8, and comprises a main valve 70 of seat valve type, pilot lines 71, 72, 73 jointly constituting a pilot circuit, a pilot valve 74, and a pressure compensating valve 75.

The pilot lines 14, 73 of the flow control valves 8, 9 are connected to the maximum load pressure line 50 through load pressure introducing lines 54, 55 which have check valves 52, 53 therein, respectively. The load pressure of either hydraulic actuator 6 or 7 on the higher pressure side is introduced as a maximum load pressure to the maximum load pressure line 50. The maximum load pressure line 50 is connected to a tank 57 through a restrictor 56.

Further, check valves 58, 59 for preventing hydraulic fluid from flowing toward the main valves 11, 70 from the hydraulic actuators 6, 7 are connected to the main lines 3, 5 downstream of the main valves 11, 70 of the flow control valves 8, 9, respectively.

The pump regulator 10 comprises an auxiliary pump 60, a swash plate tilting device 61 of hydraulic cylinder type driven by hydraulic fluid delivered from the auxiliary pump 60, and a control valve 62 connected between the tank 57 as well as the auxiliary pump 60 and the swash plate tilting device 61. The control valve 62 has first and second pilot chambers 63, 64 at its opposite ends, and a pressure setting spring 65 disposed at the end near the second pilot chamber 64. The first and second pilot chambers 63, 64 are connected to the main line 2 and the maximum load pressure line 50 through pilot lines 66, 67, respectively. With such arrangement, the control valve 62 receives the delivery pressure of the hydraulic pump 1 and the maximum load pressure plus a resilient force of the spring 65 in opposite directions, so that supply and discharge of hydraulic fluid with respect to the swash plate tilting device 61 are controlled in response to changes in the maximum load pressure. Consequently, the delivery pressure of the hydraulic pump 1 is held at a higher pressure than the maximum load pressure by a preset pressure corresponding to the resilient strength of the spring 65.

OPERATING PRINCIPLES

The operating principles of the pressure compensating valves 16, 75 will now be described. For each of the pressure compensating valves 16, 75, the pressure balance of the valve body 42 is expressed by the following equation:

$$as\ Ps + al\ Pl = am\ Plmax + az\ Pz$$

This equation can be rewritten to:

$$Pz - Pl = \frac{as}{az}(Ps - Pl\max) + \frac{1}{az}(as - am)(Pl\max - Pl) + \frac{1}{az}(as + al - am - az)Pl$$

Therefore, by substituting;

$$\alpha = \frac{as}{az}$$

$$\beta = \frac{1}{az}(as - am)$$

$$\gamma = \frac{1}{az}(as + al - am - az)$$

the above equation can now be expressed by:

$$Pz - Pl = \alpha(Ps - Plmax) + \beta(Plmax - Pl) + \gamma Pl$$

Since $Pz - Pl = \Delta Pz$, the same equation as the above one (1) is obtained.

Here, the equation (1) is set forth below, again:

$$\Delta Pz = \alpha(Ps - Plmax) + \beta(Plmax - Pl) + \gamma Pl \quad (1)$$

The equation (1) will be taken into consideration below. The left side of the equation (1) relates to a differential pressure ΔPz between the inlet pressure Pz and the outlet pressure Pl of the pilot valve 15. the first term in the right side of the equation (1) relates to a differential pressure between the delivery pressure Ps of the hydraulic pump 1 and the maximum load pressure Plmax, with $\alpha$ being a proportional constant. The second term relates to a differential pressure between the maximum load pressure Plmax and the load pressure of either the hydraulic actuator 6 or 7, i.e., self-load pressure Pl, with $\beta$ being a proportional constant. The third term is determined by the self-load pressure Pl with $\gamma$ being a proportional constant. In other words, the equation (1) means that each of the pressure compensating valves 16, 75 can control the differential pressure ΔPz between the inlet pressure Pz and the outlet pressure Pl of the pilot valve 15 based on the four pressures Ps, Plmax, Pl, Pz; that at this time, the differential pressure ΔPz can be controlled in proportion to such three elements as the differential pressure Ps−Plmax between the delivery pressure Ps of the hydraulic pump 1 and the maximum load pressure Plmax, the differential pressure Plmax−Pl between the maximum load pressure Plmax and the self-load pressure Pl, and the self-load pressure Pl, respectively; and that the respective degrees of proportion to those three elements Ps−Plmax, Plmax−Pl and Pl can optionally be set by selecting respective values of the proportional constants $\alpha,\beta,\gamma$.

In this respect, the fact that the pressure compensating valve 16, 75 controls the the differential pressure ΔPz across the pilot valve 15, 74, is equivalent to controlling the pilot flow rate passing through the pilot valve 15, 74. As a result, it is practically equivalent to controlling the main flow rate passing through the main valve 11, 70 based on the well-known function obtainable with a combination of the main valve 11, 70 of seat type and the pilot valve 15, 74, as mentioned above.

Further, the differential pressure Ps−Plmax in the first term in the right side of the equation (1) remains constant in this embodiment using the pump regulator 10 of load sensing type, so long as the pump regulator 10 is working effectively. That differential pressure is common to both the pressure compensating valves 16, 75.

As per the first term in the right side of the equation (1), therefore, controlling the differential pressure ΔPz across the pilot valve 15, 74 in proportion to the differential pressure Ps−Plmax means that the differential pressure ΔPz is controlled at constant in the operating condition where the pump regulator 10 is working effectively. Assuming the opening degree of the pilot valve 15, 74 to be constant, it also means that the main flow rate passing through the main valve 11, 70 is controlled at constant irrespective of fluctuations in the inlet pressure Ps or the outlet pressure Pl of the main valve. In short, the pressure compensating function is performed.

In the operating condition where the pump regulator 10 is not working effectively, as in the case the delivery pressure of the hydraulic pump 1 is lowered upon the total of consumed flow rates of the hydraulic actuators 6, 7 exceeding the maximum delivery flow rate of the hydraulic pump 1, the differential pressure ΔPz becomes smaller with reducing the differential pressure Ps−Plmax and, hence, the main flow rate passing through the main valve 11, 70 is also reduced. However, since the differential pressure Ps−Plmax is common to both the pressure compensating valves 16, 75, the flow rates passing through the main valves 11, 70 are reduced in the same proportion. Therefore, the flow rates passing through the main valves 11, 70 are distributed proportionally in response to the respective operated amounts of the control levers 30 (i.e., opening degrees of the pilot valves 15, 74), so that the delivery flow rate of the hydraulic pump 1 is reliably supplied to the hydraulic actuator on the higher pressure side as well. In short, the flow distributing function can be attained.

As per the second term in the right side of the equation (1), controlling the differential pressure ΔPz across the pilot valve 15, 74 in proportion to the differential pressure Plmax−Pl means that when the load pressure Plmax of the other hydraulic actuator is larger than the self-load pressure Pl, the differential pressure ΔPz across the pilot valve 15 or 74 is changed depending on the maximum load pressure Plmax of the other hydraulic actuator. Assuming the opening degree of the pilot valve 15 or 74 to be constant, it also means that the main rate passing through the main valve 11, 70 is changed depending on the maximum load pressure Plmax. While preferred flow control is generally effected by the flow control valves free of any effects from other hydraulic actuators, it may be preferable in hydraulic construction machines such as hydraulic excavators to vary the respective flow rates under the effects of load pressures of other hydraulic actuators depending on the working modes. In such modes, the second term in the right side of the equation (1) represent a harmonizing function with which the respective flow rates can be changed for harmonization with other hydraulic actuators.

Finally, as per the third term in the right side of the equation (1), controlling the differential pressure ΔPz across the pilot valve 15, 74 in proportion to the self-load pressure Pl means that the differential pressure ΔPz across the pilot valve 15 or 74 is changed in response to changes in the self-load pressure Pl. Assuming the opening degree of the pilot valve 15 or 74 to be constant, it also means that the main flow rate passing through the main valve 11, 70 is changed depending on the self-load pressure Pl. This provides a self-pressure compensating function with which the flow rate can be varied in response to changes in the self-load pressure.

As described above, the first term in the right side of the equation (1) governs the pressure compensating and flow distributing function, the second term governs the harmonizing function in combination with other hydraulic actuators, and the third term governs the self-pressure compensating function. Actuation or non-actuation and the degree of each of those three functions can optionally be set by selecting the proportional constants $\alpha,\beta,\gamma$.

Among the above three functions, the pressure compensating and flow distributing function in relation to the first term is an essential function for hydraulic construction machines such as hydraulic excavators, and is preferably held constant at all times irrespective of the types and working forms of hydraulic actuators employed. Therefore, the proportional constant $\alpha$ is set to an arbitrary positive value. Since the differential pressure ΔPz across the pilot valve 15, 74 governs the pilot flow rate corresponding to the opening degree of the pilot valve 15, 74 which is determined by the operated amount of the control lever 30, the proportional constant $\alpha$ for the differential pressure Plmax−Pl of the first term means a proportional gain of the pilot flow rate with respect to the operated amount of the control lever 30 for the pilot valve 15, 74 (opening degree of the pilot valve), i.e., a proportional gain of the main flow rate passing through the main valve 11, 70 with respect to that operated amount. Therefore, the proportional constant $\alpha$ is determined corresponding to such proportional gain.

Assuming that the ratio of the pressure receiving area As of the valve body 21 of the main valve, which receives the delivery pressure Ps of the hydraulic pump 1, to the pressure receiving area Ac of the valve body 21, which receives the pressure Pc of the back pressure chamber 24, is equal to K, the pressure balance of the valve body 21 is expressed by the following equation:

$$Pc=KPs+(1-K)Pl$$

On the other hand, the control pressure Pc and the inlet pressure Pz of the pilot valve 15, 74 have the relationship of Pc≧Pz and, when the pressure compensating valve 16, 75 is in a completely opened state, the relationship of Pc=Pz is established. Therefore, the differential pressure $Pz-Pl(=\Delta Pz)$ across the pilot valve 15, 74 is expressed by:

$$Pz-Pl\leqq Pc-Pl=K(Ps-Pl) \quad (2)$$

Thus, the maximum differential pressure obtainable with the pilot valve 15, 74 is K(Ps−Pl). Considering now the maximum load pressure side (Plmax=Pl) during the combined operation of the hydraulic actuators 6, 7, with $\beta=0$, $\gamma=0$ assumed in the foregoing equation (1):

$$Pz-Pl=\alpha(Ps-Plmax)\leqq K(Ps-Plmax) \quad (3)$$

Accordingly, if $\alpha$ is set to a value meeting $\alpha>K$, the pilot valve on the side of maximum load pressure cannot produce a differential pressure larger than K(Ps−Plmax), while the pilot valve on the lower pressure side can produce a differential pressure of $\alpha$(Ps−Plmax)>K(Ps−Plmax). This results in different pilot flow rates because the differential pressures across the pilot valves do not have an equal level with respect to each other even with the opening degrees of both the pilot valves set equal to each other. Thus, it becomes impossible to proportionally distribute the flow rate in response to the respective operated amounts. In spite of incapability of proportional distribution, however, hydraulic fluid can reliably be supplied to the hydraulic actuator on the higher pressure side as well.

For this reason, in the case of obtaining the flow distributing function for the pressure compensating valves 16, 75 to distribute the flow rates in proportion to the respective operated amounts (opening degrees) of the pilot valves, the proportional constant $\alpha$ should be set to meet $\alpha\leqq K$. In particular, where $\alpha=K$ is set, the maximum flow rate can be produced for the same opening degree of the pilot valves, thereby providing the most efficient valve structure.

Furthermore, where $\alpha$ is set to meet $\alpha>K$ as mentioned above, the differential pressure of $\alpha$(Ps−Plmax)>K(Ps−Plmax) is obtained at the pilot valve on the side of lower load pressure. But when the combined operation is switched to the sole operation of the hydraulic actuator on the side of lower load pressure, the differential pressure larger than K(Ps−Plmax) cannot be obtained at the pilot valve on the side of lower load pressure as well. Thus, the differential pressure across that pilot valve is lowered from $\alpha$(Ps−Plmax) to K(Ps−Plmax), and hence the pilot flow rate is reduced correspondingly. As a result, the flow rate supplied to that hydraulic actuator is also reduced to speed-down the associated working member, thereby making it difficult to smoothly perform the desired work. To the contrary, where $\alpha$ is set to meet $\alpha\leqq K$, the differential pressure across the pilot valve on the side of lower load pressure is limited to K(Ps−Plmax) also in the combined operation. Even when the combined operation is switched to the sole operation, no variation occurs in the differential pressure, thereby ensuring the stable work operation. Therefore, also from this viewpoint, $\alpha$ is preferably set to meet $\alpha\leqq K$.

From the foregoing, it can be understood that when the flow rates should be distributed in proportion to the respective operated amounts of control levers for a plurality of hydraulic actuators, setting of $\alpha$ to $\alpha\leqq K$ is an essential requirement.

The harmonizing function relating to the second term has different degrees of necessity depending on the types of working members and the working modes driven by the hydraulic actuators 6, 7. It is preferable for some working members and modes to be totally unaffected from the load pressure of the other hydraulic actuator. Therefore, the proportional constant $\beta$ is set to an arbitrary value inclusive of zero based on harmonization in the combined operation of the relevant hydraulic actuator with the other hydraulic actuator. The self-pressure compensating function relating to the third term has different degrees of necessity depending on the types of working members driven by the hydraulic actuators 6, 7. It is also preferable for some working members to be totally unaffected from the self-load pressure. Therefore, the proportional constant $\gamma$ is set to an arbitrary value inclusive of zero depending on the types of working members driven by the relevant hydraulic actuator.

Thus, by setting the constants $\alpha,\beta,\gamma$ to respective predetermined values, it becomes possible to attain the flow distributing function, or the harmonizing function and/or self-pressure compensating function based on the flow distributing function, and to modify characteristics of the flow control valves depending on the types of working members of hydraulic construction machines and the working modes thereof.

As mentioned above, the proportional constants $\alpha,\beta,\gamma$ are expressed using the pressure receiving areas as, al, am, az of the first through fourth hydraulic control chambers 43–46 of the pressure compensating valve 16, 75. Accordingly, if the proportional constants $\alpha,\beta,\gamma$ are once determined, the pressure receiving areas as, al, am, az are so set as to obtain those determined values of the proportional constants $\alpha,\beta,\gamma$. As special cases, the arrangement of the pressure compensating valve meeting $as+al=am+az$ allows setting of $\gamma=0$, and the arrangement thereof meeting as=am allows setting of $\beta=0$. Also, the arrangement thereof meeting as=al=am=az allows setting of $\beta=\gamma=0$.

Practical setting examples of the proportional constants $\alpha,\beta,\gamma$ will be described below in connection with the case the hydraulic drive system of this embodiment is applied to a hydraulic excavator of backhoe type.

Figure 3:
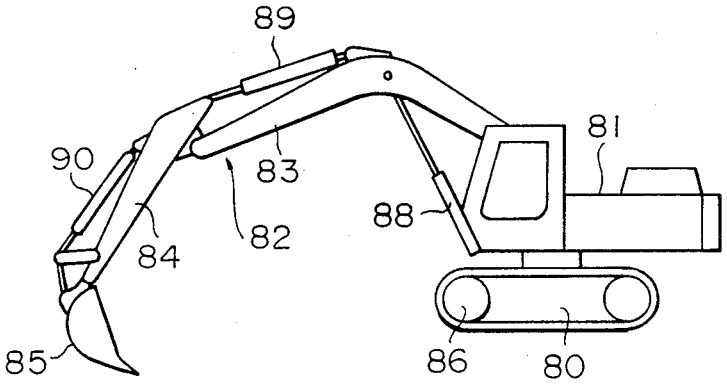
FIG. 3 is a side view of a hydraulic excavator to which the hydraulic drive system of the present invention is to be applied.
Figure 4:
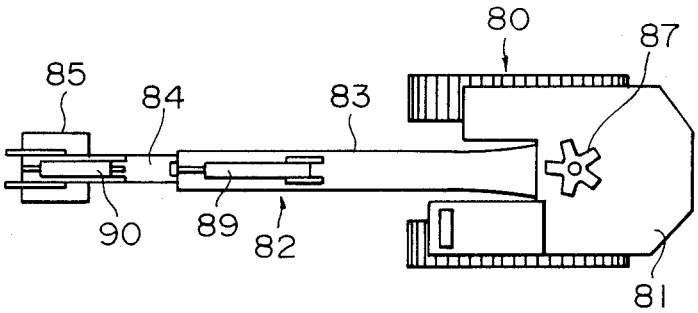
FIG. 4 is a plan view of the hydraulic excavator.

As shown in FIGS. 3 and 4, a hydraulic excavator generally comprises a pair of track bodies 80, a swing body 81 swingably installed on the track bodies 80, and a front attachment 82 mounted onto the swing body 81 rotatably in a vertical plane. The front attachment 82 comprises a boom 83, an arm 84 and a bucket 85. The track bodies 80, swing body 81, boom 83, arm 84 and bucket 85 are driven by a plurality of track motors 86, swing motor 87, boom cylinder 88, arm cylinder 89 and bucket cylinder 90, respectively. Herein, the swing motor 87, boom cylinder 88, arm cylinder 89 and bucket cylinder 90 each correspond to one or more hydraulic actuators 6, 7 shown in FIG. 1.

Figure 5:
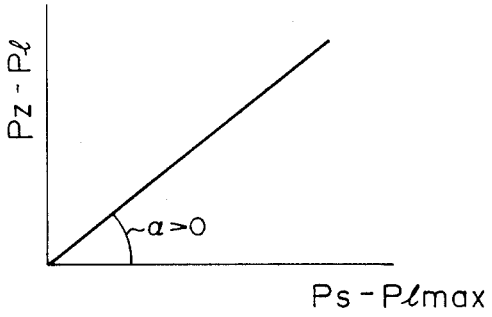
FIG. 5 is a characteristic graph showing a setting example of the constant $\alpha$ for a pressure compensating valve included in one flow control valve of the hydraulic drive system.
Figure 6A:
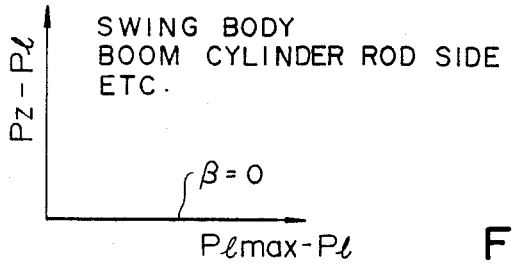
FIGS. 6(A) through 6(D) are characteristic graphs each showing a setting example of the constant $\beta$ for a pressure compensating valve included in one flow control valve of the hydraulic drive system.
Figure 6B:
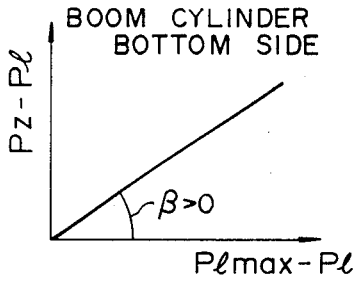
Figure 6C:
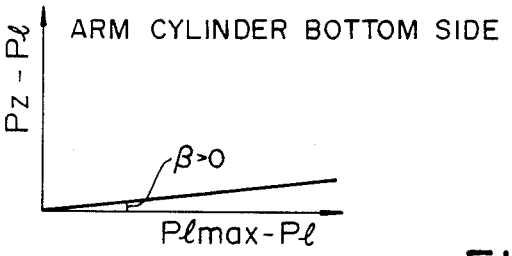
Figure 6D:
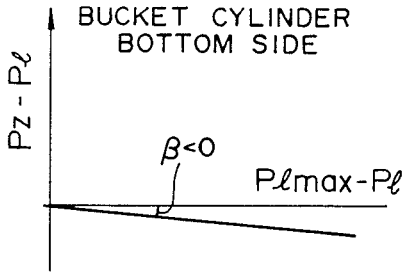
Figure 7A:
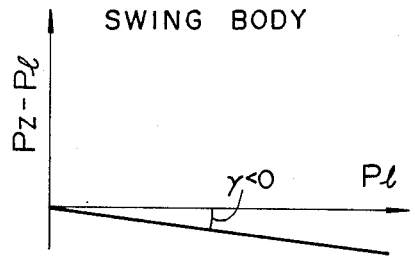
FIGS. 7(A) through 7(C) are characteristic graphs each showing a setting example of the constant $\gamma$ for a pressure compensating valve included in one flow control valve of the hydraulic drive system.
Figure 7B:
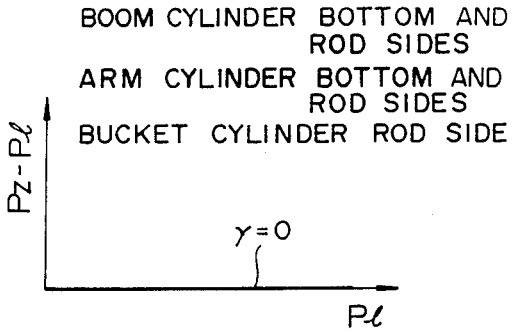
Figure 7C:
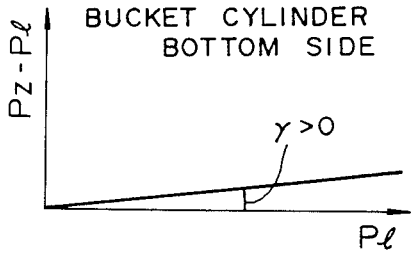

In the hydraulic drive system for such a hydraulic excavator, the proportional constants $\alpha$ of the first term commonly affecting to all flow control valves of the swing motor 87, boom cylinder 88, arm cylinder 89 and bucket cylinder 90 are set to the same arbitrary positive value taking into account the above-mentioned proportional gain, as shown in FIG. 5 by way of example. For a flow control valve associated with the swing motor 87, the proportional constant $\beta$ is set to be $\beta=0$ as shown in FIG. 6(A) and the proportional constant $\gamma$ is set to a relatively small negative value as shown in FIG. 7(A). For a flow control valve associated with the bottom side of the boom cylinder 88, the proportional constant $\beta$ is set to an arbitrary positive value as shown in FIG. 6(B) and the proportional constant $\gamma$ is set to be $\gamma=0$ as shown in FIG. 7(B). For a flow control valve associated with the bottom side of the arm cylinder 89, the proportional constant $\beta$ is set to a relatively small positive value as shown in FIG. 6(C) and the proportional constant $\gamma$ is set to be $\gamma=0$ as shown in FIG. 7(B). For a flow control valve associated with the bottom side of the bucket cylinder 90, the proportional constant $\beta$ is set to a relatively small negative value as shown in FIG. 6(D) and the proportional constant $\gamma$ is set to a relatively small positive value as shown in FIG. 7(C). For a flow control valve associated with the rod side of the boom cylinder 88, a flow control valve associated with the rod.side of the arm cylinder 89, and a flow control valve associated with the rod side of the bucket cylinder 90, the proportional constants $\beta$, $\gamma$ are all set to zero as shown in FIGS. 6(A) and 7(B).

OPERATION OF THE EMBODIMENT

Operation of the hydraulic drive system thus arranged will be described below.

First, at the time the control levers 30 of the flow control valves 8, 9 are both not being operated, the pilot valves 15, 74 are closed and, hence, no pilot flow rates pass through the pilot circuits 12–14, 71–73. Therefore, hydraulic fluid will not flow through the respective variable restrictors 23 of the main valves 11, 70, so the control pressure Pc of the back pressure chamber 24 is equal to the pressure Ps at the inlet port 17 (i.e., delivery pressure of the hydraulic pump 1). Further, due to the above-mentioned action of the pump regulator 10 of load sensing type, the delivery pressure Ps of the hydraulic pump 1 is held at a pressure level higher than the maximum load pressure Plmax between the hydraulic actuators 6, 7 by an amount of pressure corresponding to a preset value of the spring 65. Thus, since the pressure receiving areas of each valve body 21 have the relationship of $Ac=As+Al$ and are under Ps>Pl, each valve body 21 is urged in the valve-closing direction by virtue of the control pressure Pc so that the main valves 11, 70 are held in a closed state. Meanwhile, the pressure compensating valves 16, 17 are held in an open state with the above-mentioned setting of the pressure receiving areas as, al, am, az.

Next, when the control lever 30 of the flow control valve 8 is operated solely, the pilot valve 15 is opened in response to the operated amount thereof to produce a pilot flow in the pilot circuit 12–14, so the pilot flow rate passes corresponding to the opening degree of the pilot valve 15. As mentioned above, this causes the valve body 21 of the main valve to be opened to an opening degree proportional to the pilot flow rate under the action of the variable restrictor 23 and the back pressure chamber 24. As a result, the flow rate corresponding to the operated amount of the control lever 30 (i.e., opening degree of the pilot valve 15) is passed from the inlet port 17 to the outlet port 18 through the main valve 11.

In the resulting state where the pilot valve 15 is opened by a predetermined degree and a certain flow rate is passed from the inlet port 17 to the outlet port 18, if the differential pressure between the inlet port 17 and the outlet port 18 is to be reduced upon an increase in the pressure of the outlet port 18, for example, then the pump regulator 10 of load sensing type functions to increase the delivery pressure of the hydraulic pump 1, so that the differential pressure between the pressure at the inlet port 17 (i.e., delivery pressure of the hydraulic pump 1) and the pressure at the outlet port 18 (i.e., load pressure of the hydraulic actuator 6; maximum load pressure) is held constant. Therefore, the certain flow rate corresponding the operated amount of the control lever 30 still continues to pass through the main valve 11.

In such sole operation of the hydraulic actuator 6, where the pressure receiving areas as, al, am, az of the pressure compensating valve 16 are set such that the proportional constant $\gamma$ in the above equation (1) relating to a self-pressure compensating characteristic takes an arbitrary value other than zero, the differential pressure Pz−Pl across the pilot valve 15 is controlled in response to changes in the load pressure of the hydraulic actuator 6 (i.e., self-load pressure), thereby carrying out self-pressure compensation of the load pressure.

Taking the hydraulic excavator described above with reference to FIGS. 3 through 7 as an example, the proportional constant $\gamma$ for the flow control valve associated with the swing motor 87 is set to a negative value near zero as shown in FIG. 7(A). More specifically, when driving the swing body 81, the load pressure is increased beyond the limit pressure of a relief valve provided to protect the circuit since the swing body is of an inertial body. This results in waste of energy. In this respect, by setting the proportional constant $\gamma$ to a negative value, the differential pressure Pz−Pl is controlled to be reduced with increasing the load pressure of the swing body, thereby reducing the flow rate passing through the flow control valve. This makes smaller the amount of flow rate dissipated away as a surplus flow rate from the relief valve even if the load pressure is raised up, and hence less energy is wasted.

For the flow control valve associated with the bottom side of the bucket cylinder 90, the proportional constant $\gamma$ is set to a small positive value as shown in FIG. 7(C). Accordingly, as the self-load pressure is raised up during the excavation, the differential pressure Pz−Pl is increased to enlarge the flow rate passing through the flow control valve. Thus, the excavation speed of bucket is increased. This enables excavation with powerful feeling and improved operability.

Next, when both the control levers 30 of the flow control valves 11, 70 are operated concurrently, the operation proceeds as follows. First, in a like manner to the above case the flow control valve 11 is operated solely. The pilot flow rates corresponding to the operated amounts of the control levers 30 pass through the respective flow control valves 11, 70. Thus, the flow rates corresponding to the operated amounts of the control levers 30 (i.e., opening degrees of the pilot valves 15, 74) are passed from the inlet ports 17 to the outlet ports 18 through the main valves 11, 70 under the action of the variable restrictors 23 and the back pressure chambers 24.

In the combined operation of the two hydraulic actuators 6, 7, the pressure compensating and flow distributing function is carried out by previously setting the pressure receiving areas as, al, am, az of each of the pressure compensating valves 16, 17 such that the proportional constant $\alpha$ for the first term in the right side of the equation (1) takes an arbitrary positive value as shown in FIG. 5.

Therefore, during the condition where the pump regulator 10 of load sensing type is working effectively in the hydraulic excavator described above with reference to FIGS. 3 through 7 by way of example, it is possible to drive respective working members with respective certain flow rates corresponding to the operated amounts of their control levers and carry out the combined operation steadily. Further, even when coming into the condition where the total of consumed flow rates of the hydraulic actuators 6, 7 exceeds the maximum delivery flow rate of the hydraulic pump 1 and the pump regulator 10 can no longer work effectively, hydraulic fluid is reliably supplied to not only the hydraulic actuator on the lower pressure side, but also the hydraulic actuator on the higher pressure side, to thereby ensure that all of the working members can be driven positively. In particular, where $\alpha \leqq K$ is set, there occurs no variation in the flow rates supplied to the respective hydraulic actuators even upon switching from the combined operation to the sole operation. This enables to steadily continue the work.

Setting of $\alpha \leqq K$ also makes it possible to supply the flow rates to the respective hydraulic actuators accurately in proportion to the operated amounts of the corresponding control levers. In particular, where the pressure receiving areas as, al, am, az of the pressure compensating valves 16 are selected such that the proportional constants $\alpha,\gamma$ in the above equation (1) become zero, the path along which each working member moves can accurately be controlled corresponding to the operated amount of the control lever. By way of example, as shown in FIG. 6(A) and 7(B), $\beta=0$, $\gamma=0$ are set for the flow control valve associated with the rod side of the boom cylinder 88 and the flow control valve associated with the rod side of the arm cylinder 89. With such setting, during the work of making up the normal surface of a downward slope by the use of the boom and arm, any effects from the load pressures of other hydraulic actuators and the self-load pressure is completely eliminated. Thus, the flow rates supplied to the boom cylinder 88 and the arm cylinder 89 can be distributed in proportion to the respective operated amounts of the boom and arm control levers for accurate making-up of the normal surface.

Moreover, in the above arrangement of the present invention, the auxiliary valves are installed in not the main circuits but the pilot circuits. Therefore, the fluid leakage is very small even when the hydraulic circuit is highly pressurized, and appreciable pressure loss will not occur if a large flow rate is passed through the main circuit.

Furthermore, where the pressure receiving areas as, al, am, az of the pressure compensating valves 16 are set such that the proportional constant $\beta$ and/or $\gamma$ in the above equation (1) takes an arbitrary value other than zero, the harmonizing function and/or the self-load pressure compensating function based on the above pressure compensating and flow distributing function are performed so as to change the main flow rates passing through the main valves 11, 70 depending on the maximum load pressure Plmax among other hydraulic actuators and/or the self-load pressure Pl.

In case of the hydraulic excavator described above with reference to FIGS. 3 through 7, for example, the proportional constant $\beta$ for the flow control valve associated with the swing motor 87 is set to be $\beta=0$ as shown in FIG. 6(A), and the proportional constant $\beta$ for the flow control valve associated with the bottom side of the boom cylinder 88 is set to an arbitrary positive value as shown in FIG. 6(B). Generally, when the swing and boom-up operations are actuated at the same time, the load pressure of the swing motor becomes higher at the initial stage of swing operation since the swing body 81 is of an intertial body. However, when the swing operation reaches the maximum speed, the load pressure is reduced. On the other hand, since the load pressure of the boom cylinder is given by a boom holding pressure, it is lower than the load pressure of the swing motor at the initial stage of swing operation. Also, when the swing and boom-up operations are actuated in digging work effected by an excavator of backhoe type, for example, it is preferable that even if an operator concurrently operates both the swing and boom-up control levers up to their full strokes for simpler manual operation, the boom-up and swing speeds are automatically adjusted such that the boom-up speed is increased faster than the swing speed at the initial stage and, after the boom has been raised up to some extent, the swing speed is increased gradually. By setting the proportional constant $\beta$ as mentioned above, the flow control valve associated with the boom operates in such a manner that during the time the load pressure of the swing motor is high and the differential pressure Plmax−Pl is large at the initial stage of swing operation, the differential pressure $\Delta$Pz across the pilot valve is also large to increase the flow rate supplied to the boom cylinder, and thereafter $\Delta$Pz is reduced gradually as the differential pressure Plmax−Pl is lowered. As a result, the boom-up and swing speeds can be adjusted automatically and the operator can make the manual operation more easily.

For the flow control valve associated with the bottom side of the arm cylinder 89, the proportional constant $\beta$ is set to a relatively small positive value as shown in FIG. 6(C). When the excavation is carried out by the combined operation using the arm, all of the hydraulic actuators have to work, but at this time, hydraulic fluid tends to flow into the actuator on the lower pressure side in a larger amount. Therefore, hydraulic fluid is restricted at the time passing through the flow control valve, which increases the energy. Consequently, fuel economy and heat balance of the hydraulic fluid will both deteriorate. By setting the proportional constant $\beta$ within a range where the balance of combined operation will not be impaired, as mentioned above, the opening degree of the main valve for the flow control valve associated with the arm is increased in response to rise of the differential pressure Plmax−Pl, and hence the restriction degree of hydraulic fluid becomes smaller. This enables less degradation of both fuel economy and heat balance.

Further, for the flow control valve associated with the bottom side of the bucket cylinder 90, the proportional constant $\beta$ is set to a relatively small negative value as shown in FIG. 6(D). When a groove is dug by the combined operation of the boom and the bucket with the boom cylinder subject to the maximum pressure for restricting movement of the bucket, for example, the load applied to the bucket is reduced abruptly at the moment it comes up to the ground surface, which will produce a shock. By setting the proportional constant $\beta$ to the small negative value as mentioned above, the increasing differential pressure Plmax−Pl acts on the differential pressure $\Delta$Pz as a negative factor to proportionally reduce the latter, so that the pilot flow rate is reduced to speed down the bucket. This mitigates the shock which would be otherwise caused at the moment of abrupt reduction in the load, and also improves both safety in operations and feeling during the work.

As per the self-pressure compensation, it is performed for each of actuators used in the combined operation substantially in the same manner as the case described in connection with the sole operation of one hydraulic actuator.

As seen from the above, the hydraulic drive system of this embodiment can provide the flow distributing function, or the harmonizing function and/or the self-pressure compensating function based on the flow distributing function, and can modify the characteristics of the flow control valves depending on the types of working members of hydraulic construction machines and the working modes thereof, by properly selecting the respective pressure receiving areas of each of the pressure compensating valves and setting the proportional constants $\alpha$, $\beta$, $\gamma$ to their predetermined values.

Furthermore, in the hydraulic drive system of this embodiment, each pressure compensating valve serving as an auxiliary valve is disposed in not the main circuit but the pilot circuit, and each main valve disposed in the main circuit is constituted by a seat valve. Therefore, fluid leakage is very small, which makes the hydraulic circuit more suitable for higher pressurization. In addition, since the auxiliary valve is disposed in the pilot circuit, appreciable pressure loss will not occur at the auxiliary valve even if a large flow rate is passed through the main circuit. This is also economical.

The foregoing embodiment has been described, with reference to FIGS. 5 through 7, as setting the constants $\beta$, $\gamma$ in the equation (1) to the predetermined values other than zero for the particular flow control valves associated with the swing body, boom, arm and bucket of the hydraulic excavator. However, the present invention is not limited to such embodiment, and the constants $\beta$, $\gamma$ may be set to zero for all the flow control valves. Even in this case, by setting the constant $\alpha$ in the equation (1) to a positive value, particularly such a value as meeting $\alpha \leqq K$, the above-mentioned pressure compensating and flow distributing function can be attained in the circuit arrangement which is less subject to fluid leakage and pressure loss.

OTHER EMBODIMENTS 1

Another embodiment of the present invention will first be described below with reference to FIGS. 8 and 9. Note that identical members in these figures to those in the embodiment shown in FIG. 1 are designated at the same reference numerals.

In the foregoing embodiment, the delivery pressure Ps of the hydraulic pump 1, the maximum load pressure Plmax, and the inlet and outlet pressures Pz, Pl of the pilot valves 15, 74 are directly employed for controlling the pressure compensating valves 16, 75. However, these four pressures are related to each other via the control pressure of the back pressure chamber 24, so it is also possible to control the pressure compensating valves and provide the above-mentioned characteristics to the respective pressure compensating valves without direct use of all the four pressures. FIGS. 8 and 9 shows another embodiment in which the four pressures are not directly employed for controlling the pressure compensating valves from the above standpoint. In addition, although FIG. 1 shows only the flow control valves 8, 9 disposed in the meter-in (inlet side) circuit as used when the hydraulic actuators 6, 7 are actuated to be extended or rotated in one direction, the flow control valves 8, 9 function each as a part of a directional control valve in a practical circuit. For clarity of this point, FIG. 8 shows an overall arrangement of the directional control valve.

Figure 8:
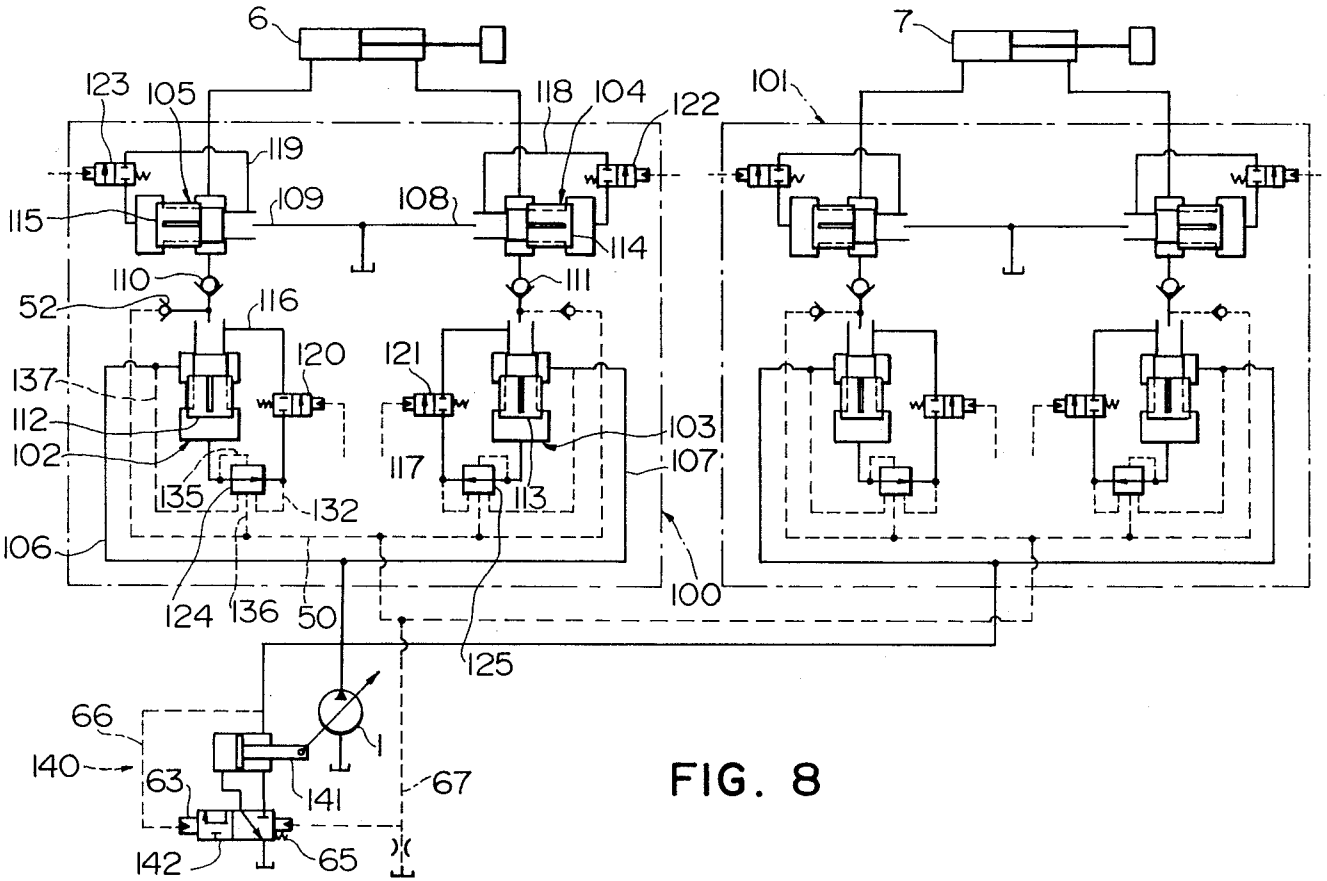
FIG. 8 is a schematic view showing an overall arrangement of a hydraulic drive system according to another embodiment of the present invention.

More specifically, in FIG. 8, directional control valves 100, 101 for controlling actuation of hydraulic cylinders 6, 7 are disposed between a hydraulic pump 1 and the hydraulic cylinders 6, 7, respectively, the directional control valve 100 comprising four flow control valves 102, 103, 104, 105 of seat valve type. The first flow control valve 102 is connected to a meter-in (inlet side) circuit 106 as used when the hydraulic cylinder 6 is actuated to be extended, and it corresponds to the flow control valve 8 in the embodiment shown in FIG. 1. The second flow control valve 103 is connected to a meter-in circuit 107 as used when the hydraulic cylinder 6 is actuated to be contracted, the third flow control valve 104 is connected to a meter-out (outlet side) circuit 108, between the hydraulic cylinder 6 and the second flow control valve 103, as used when the hydraulic cylinder 6 is actuated to be extended, and the fourth flow control valve 105 is connected to a meter-out circuit 109, between the hydraulic cylinder 6 and the first flow control valve 102, as used when the hydraulic cylinder 6 is actuated to be contracted. A check valve 110 for preventing hydraulic fluid from reversely flowing toward the first flow control valve is connected between the first flow control valve 102 and the fourth flow control valve 105, while another check valve 111 for preventing hydraulic fluid from reversely flowing toward the second flow control valve is connected between the second flow control valve 103 and the third flow control valve 104.

The first through fourth flow control valves 102–105 comprise main valves 112, 113, 114, 115 of seat valve type, pilot circuits 116, 117, 118, 119 associated with the corresponding main valves, and pilot valves 120, 121, 122, 123 connected to the corresponding pilot circuits, respectively. The first and second flow control valves 102, 103 further include respective pressure compensating valves 124, 125 connected to the pilot circuits 116, 117 in series with the pilot valves 120, 121. The structure and function of each of the main valves 112–115 are identical to those of the main valve 11, 70 of the embodiment shown in FIG. 1. More specifically, when the pilot valves 120–123 are operated, pilot flow rates corresponding to the opening degrees of the pilot valves are produced in the pilot circuits 116–119, respectively. Thus, a valve body 21 of each main valve is opened to an opening degree proportional to the pilot flow rate under the action of a variable restrictor 23 and a back pressure chamber 24, so that a flow rate corresponding to the opening degree of each of the pilot valves 120–123 is passed from an inlet port 17 to an output port 18 through the main valve 11.

Figure 9:
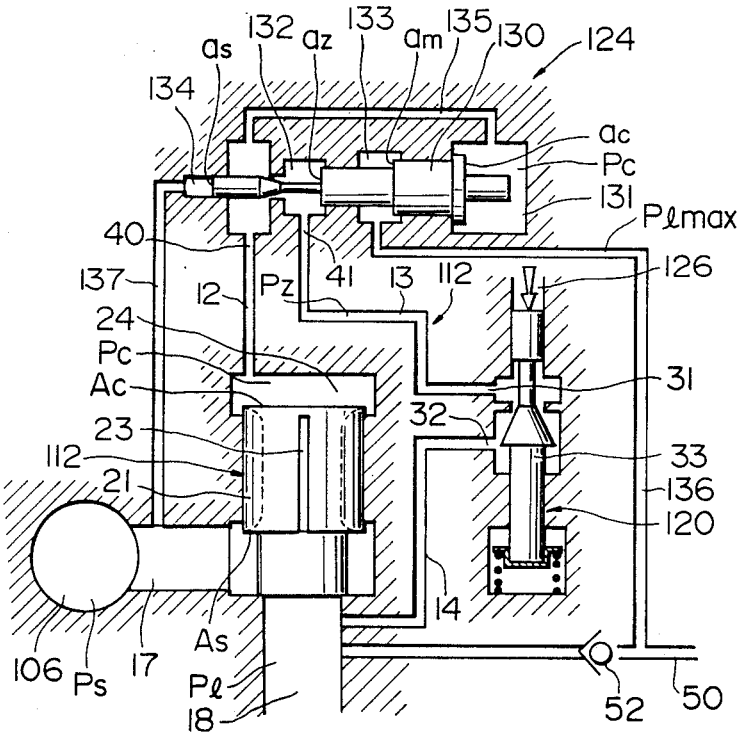
FIG. 9 is a sectional view showing the structure of a flow control valve of the hydraulic drive system of FIG. 8.

As shown in FIG. 9, each of the pilot valves 120–123 is basically identical to the pilot valves 15, 74 shown in FIG. 1 except for that the former has a hydraulic control portion 126.

As detailed in FIG. 9, the pressure compensating valve 124 comprises a valve body 130 of spool type, a first hydraulic control chamber 131 for urging the valve body 130 in the valve-opening direction, and second, third and fourth hydraulic chambers 132, 133, 134 positioned in opposite relation to the first hydraulic control chamber 131 for urging the valve body 130 in the valve-closing direction. The first hydraulic control chamber 131 is connected to the back pressure chamber 24 of the main valve 112 through a pilot line 135, the second hydraulic control chamber 132 is defined so as to communicate with an outlet port 41 of the pressure compensating valve 124, the third hydraulic control chamber 133 is connected to a maximum load pressure line 50 through a pilot line 136, and the fourth hydraulic control chamber 134 is connected to the main circuit 106 at the inlet port 17 side of the main valve 112 through a pilot line 137. With the above arrangement, the control pressure Pc of the back pressure chamber 24 is introduced to the first hydraulic control chamber 131, the inlet pressure Pz of the pilot valve 120 is introduced to the second hydraulic chamber 132, the maximum load pressure Plmax is introduced to the third hydraulic control chamber 133, and the delivery pressure Ps of the hydraulic pump 1 is introduced to the fourth hydraulic control chamber 134. Then, the end surface of the valve body 130 facing the first hydraulic control chamber 131 defines a pressure receiving area ac which receives the control pressure Pc of the back pressure chamber 24, the annular end surface of the valve body 130 facing the second hydraulic control chamber 132 defines a pressure receiving area az which receives the inlet pressure Pz of the pilot valve 120, the end surface of the valve body 130 facing the third hydraulic control chamber 133 defines a pressure receiving area am which receives the maximum load pressure Plmax, and the end surface of the valve body 130 facing the fourth hydraulic control chamber 134 defines a pressure receiving area as which receives the delivery pressure Ps of the hydraulic pump 1. These pressure receiving areas as, ac, am, az are so set as to obtain the predetermined values of the proportional constants $\alpha$, $\beta$, $\gamma$ as described later on. At the same time, the pressure receiving areas as, ac, am, az are set to hold the valve body 130 in an open position while the main valve 112 and the pilot valve 120 are being closed.

The pressure compensating valve 125 is constructed similarly to the pressure compensating valve 124.

Also, the directional control valve 101 associated with the hydraulic cylinder 7 is constructed similarly to the directional control valve 100.

The hydraulic pump 1 is associated with a pump regulator 140 of load sensing type for holding the delivery pressure of the hydraulic pump 1 higher a predetermined value than a maximum load pressure between the plurality of hydraulic actuators 6, 7.

The pump regulator 140 comprises a swash plate tilting device 141 of hydraulic cylinder type and a control valve 142. The swash plate tilting device 141 is driven based on an area difference between a rod side cylinder chamber and a head side cylinder chamber, depending on a position of the control valve 142 for controlling the delivery flow rate of the hydraulic pump 1. The control valve 142 is driven in a like manner to the control valve 62 shown in FIG. 1. More specifically, the control valve 142 undergoes the delivery pressure of the hydraulic pump 1 plus the maximum load pressure and a preset resilient force of a spring 65, which act thereon in opposite directions to control the swash plate tilting device 141 in response to changes in the maximum load pressure, thereby holding the delivery pressure of the hydraulic pump 1 higher than the maximum load pressure by a pressure value corresponding to the resilient strength of the spring 65.

In the hydraulic drive system thus arranged, the pressure balance of the valve body 130 in the pressure compensating valve 124, for example, is expressed by the following equation:

$$ac\ Pc = as\ Ps + am\ Plmax + az\ Pz$$

Also, the pressure balance of the valve body 21 in the main valve is expressed by the following equation:

$$Ac\ Pc = As\ Ps + al\ Pl$$

From the above two equations, the differential pressure across the pilot valve 120 is given by:

$$Pz - Pl = \left(\frac{as}{az} \quad \frac{As}{Ac}\right)Ps - \frac{am}{az} Pl\max + \left(\frac{ac}{az} \quad \frac{Al}{Ac} - 1\right)Pl$$

Using the relationship of $Ac=As+Al$, this equation can be rewritten as follows:

$$Pz - Pl = \frac{1}{az}\left(ac\frac{As}{Ac} - as\right)(Ps - Pl\max) + \frac{1}{az}\left(ac\frac{As}{Ac} - as - am\right)(Pl\max - Pl) + \frac{1}{az}(ac - as - am - az)Pl$$

Therefore, by substituting;

$$\alpha = \frac{1}{az}\left(ac\frac{As}{Ac} - as\right)$$

$$\beta = \frac{1}{az}\left(ac\frac{As}{Ac} - as - am\right)$$

$$\gamma = \frac{1}{az}(ac - as - am - az)$$

the above equation can now be expressed by:

$$Pz-Pl=\alpha(Ps-Pl\max)+\beta(Pl\max-Pl)+\gamma Pl \quad (4)$$

Assuming the differential pressure across the pilot valve 120 to be ΔPz, the left side is replaced by ΔPz since $Pz-Pl=\Delta Pz$. Thus, there can be obtained the same equation as that derived in the embodiment shown in FIG. 1.

Also in this embodiment, therefore, by setting the proportional constants $\alpha$, $\beta$, $\gamma$ to their predetermined values, the differential pressure ΔPz across the pilot valve 120 can be controlled in proportion to three factors; the differential pressure Ps−Plmax between the delivery pressure Ps of the hydraulic pump 1 and the maximum load pressure Plmax, the differential pressure Plmax−Pl between the maximum load pressure Plmax and the self-load pressure Pl, and the self-load pressure Pl, respectively, thereby enabling to attain the pressure compensating and flow distributing function (first term in the right side), or the harmonizing function (second term in the right side) and/or the self-pressure compensating function (third term in the right side) in the combined operation based on the pressure compensating and flow distributing function, as mentioned above. In other words, this embodiment introduces the control pressure Pc, the inlet pressure Pz of the pilot valve 120, the maximum load pressure Plmax and the delivery pressure Ps of the hydraulic pump 1 rather than directly using the inlet and outlet pressures Pz, Pl of the pilot valve 120, the delivery pressure Ps of the hydraulic pump 1 and the maximum load pressure Plmax, in order to provide the same effect as attained using the latter four pressures Pz, Pl, Ps, Plmax.

Figure 10:
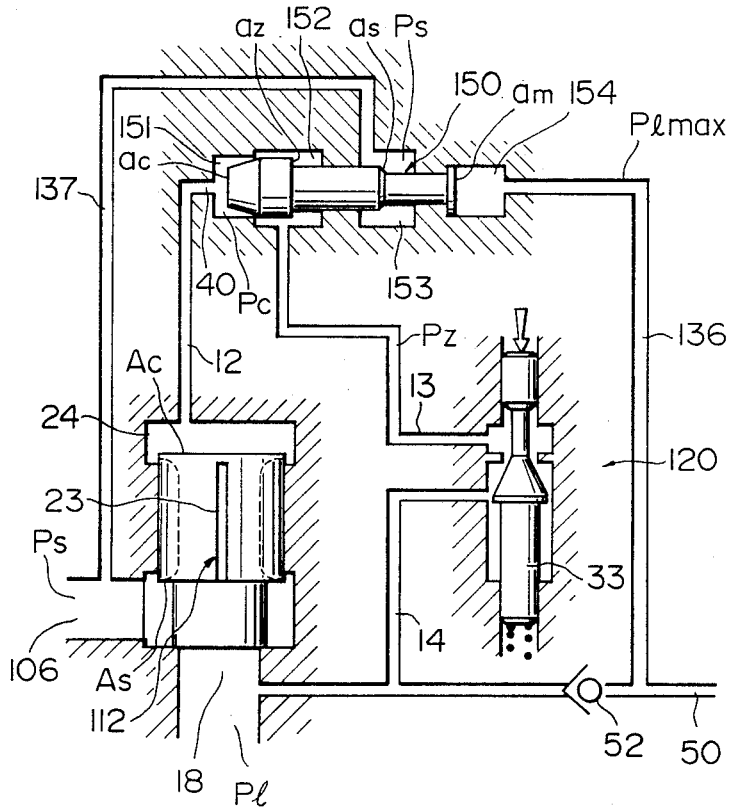
FIG. 10 is a sectional view showing a modification of the flow control valve of FIG. 9.

FIG. 10 shows a modification in which the hydraulic control chambers of the pressure compensating valve shown in FIG. 9 is changed in their layout. More specifically, in a pressure compensating valve 150 of this modified embodiment, a first hydraulic control chamber 151 receiving the control pressure Pc of the back pressure chamber 24 is located adjacent to the back pressure chamber 24, the aforesaid pilot line 135 is dispensed with the first hydraulic control chamber 151. Three hydraulic control chambers located in opposite relation to the first hydraulic control chamber 151 are arranged in the order of a hydraulic control chamber 152 receiving the inlet pressure Pz of the pilot valve 120, a hydraulic control chamber 153 receiving the delivery pressure Ps of the hydraulic pump 1, and a hydraulic control chamber 154 receiving the maximum load pressure Plmax. With the hydraulic control chambers thus arranged, the above equation (4) is also established, and hence there can be obtained the same effect as with the embodiment shown in FIG. 9.

Figure 11:
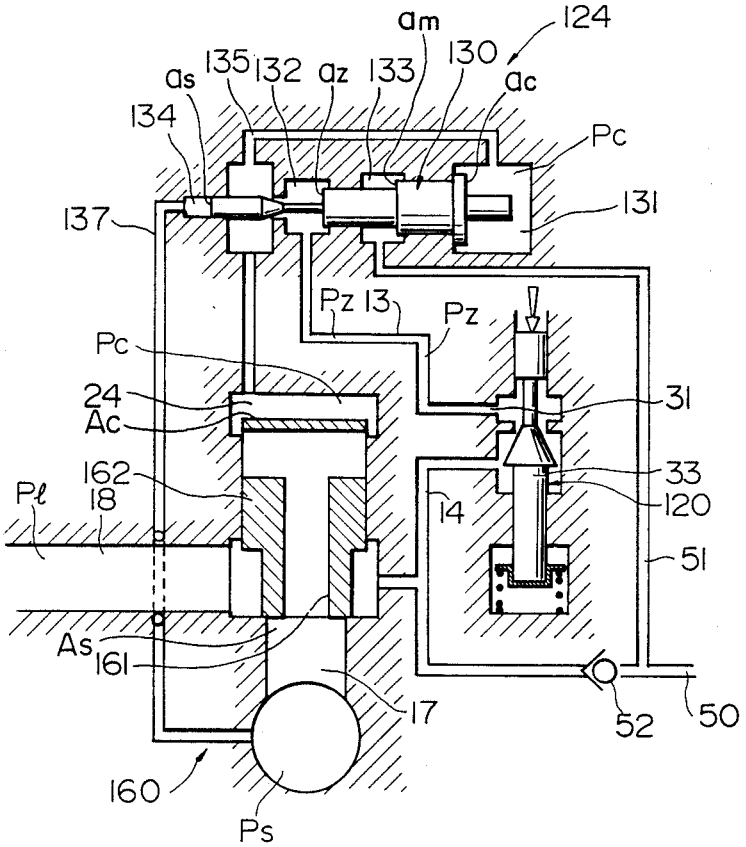
FIG. 11 is a sectional view showing another modification of the flow control valve of FIG. 9.

FIG. 11 shows a modified structure of the main valve of seat type. In this modification, a main valve 160 of seat type includes a valve body 162 having a through hole 161 capable of communicating the inlet port 17 with the back pressure chamber 24, in place of the valve body having the slits 23 as a variable restrictor which was used in the foregoing embodiment. The through hole 161 serves as a variable restrictor adapted to change the restricted amount of hydraulic fluid in response to movement of the valve body 162. Further, while in the foregoing embodiment, the axial direction of the inlet port 17 is normal to the direction of movement of the valve body 21 and the axial direction of the outlet port 18 is aligned with the direction of movement of the valve body 21, this modified embodiment is arranged such that the axial direction of the inlet port 17 is aligned with the direction of movement of the valve body 162 and the axial direction of the outlet 18 is normal to the direction of movement of the valve body 162.

In this embodiment, the bottom end surface of the valve body 162 defines the pressure receiving area As which receives the pump delivery pressure Ps. In addition, the direction of flow of hydraulic fluid passing from the inlet port 17 to the outlet port 18 is reversed in contrast with the foregoing embodiment.

The main valve 160 in this embodiment also functions in a like manner to the main valve 11 of the foregoing embodiment, so that the main flow rate corresponding to the pilot flow rate can be passed under the action of the variable restrictor provided by the through hole 161 and the back pressure chamber 24. As a result, the pressure compensating valve 124 is able to function in a like manner to that in the embodiment of FIG. 9 with the same effect.

Figure 12:
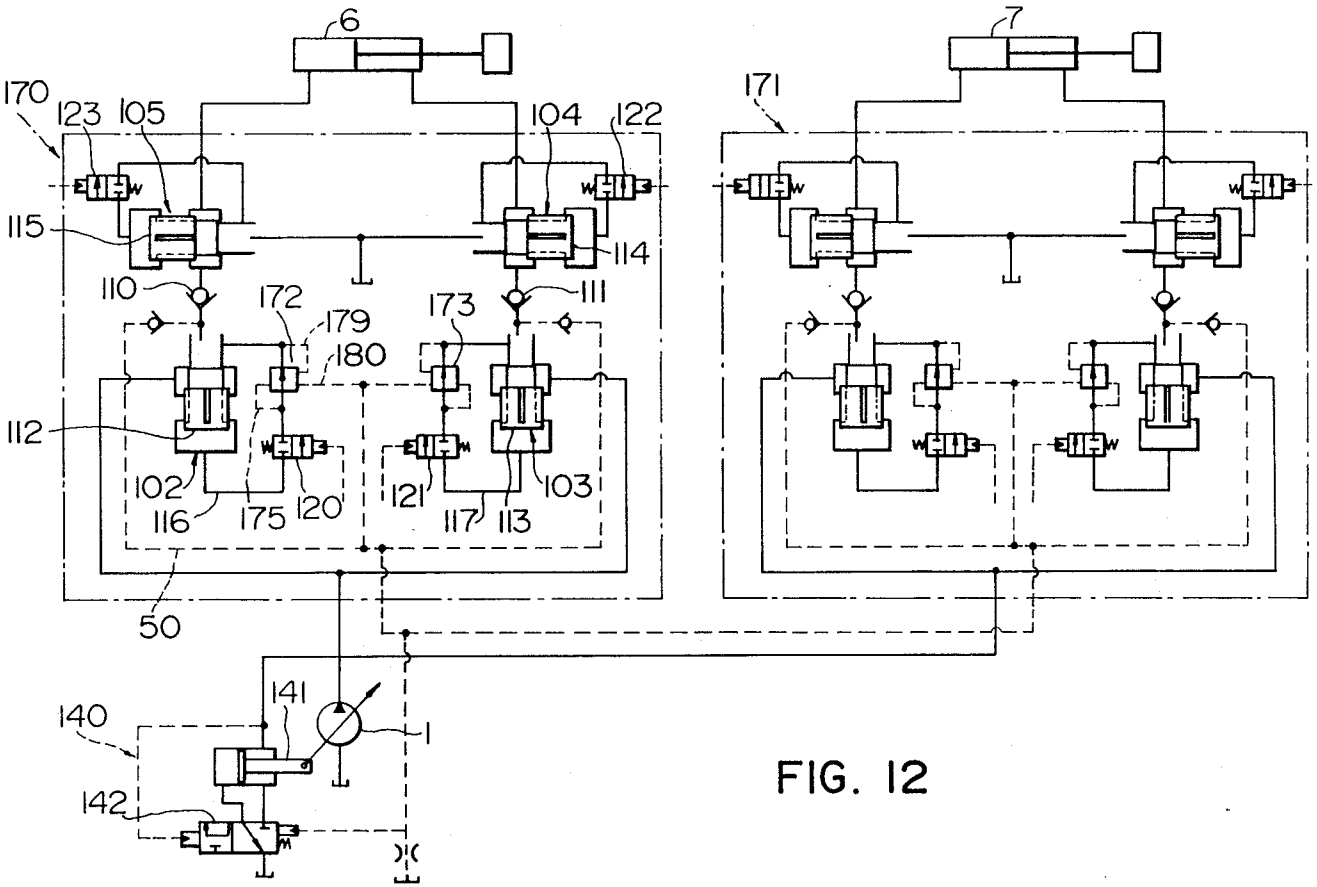
FIG. 12 is a schematic view showing an overall arrangement of a hydraulic drive system according to still another embodiment of the present invention.
Figure 13:
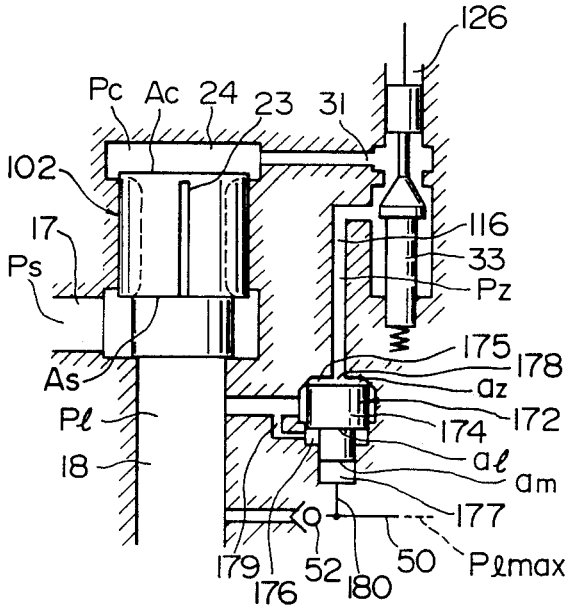
FIG. 13 is a sectional view showing the structure of a flow control valve of the hydraulic drive system of FIG. 12.

Still another embodiment of the present invention will now be described with reference to FIGS. 12 and 13. In these figures, identical members to those shown in FIGS. 2 and 9 are designated at the same reference numerals.

In this embodiment, directional control valves are designated at 170, 171 which are identical in their arrangement to those of the embodiment shown in FIG. 8 except for the structure of pressure compensating valves 172, 173.

First, the pressure compensating valve 172 (173) is different from that in the foregoing embodiment in location of the pilot circuit 116 (117). Specifically, the pressure compensating valve 172 (173) is connected to the pilot circuit 116 (117) between the outlet side of the pilot valve 120 (121) and the outlet port 18 of the main valve. Another difference is in pressures which are introduced for controlling the pressure compensating valve. More specifically, the pressure compensating valve 172 (173) comprises a valve body 174 of spool type, a first hydraulic control chamber 175 for urging the valve body 174 in the valve-opening direction, and second and third hydraulic control chambers 176, 177 for urging the valve body 174 in the valve-closing direction. The first hydraulic control chamber 175 is defined so as to communicate with an inlet port 178 of the pressure compensating valve, the second hydraulic control chamber 176 is connected to the outlet port 18 of the main valve 102 (103) through a pilot line 179, and the third hydraulic control chamber 177 is connected to the maximum load pressure line 50 through a pilot line 180. With the above arrangement, the outlet pressure Pz of the pilot valve 120 (121) is introduced to the first hydraulic control chamber 175, the outlet pressure (load pressure) Pl of the main valve 102 (103) is introduced to the second hydraulic control chamber 176, and the maximum load pressure Plmax is introduced to the third hydraulic control chamber 177. The end surface of the valve body 174 facing the first hydraulic control chamber 175 defines a pressure receiving area az which receives the outlet pressure Ps of the pilot valve, the annular end surface of the valve body 174 facing the second hydraulic control chamber 176 defines a pressure receiving area al which receives the outlet pressure Pl of the main valve, and the end surface of the valve body 174 facing the third hydraulic control chamber 177 defines a pressure receiving area am which receives the maximum load pressure Plmax. These pressure receiving areas az, al, am are so set as to obtain the predetermined values of proportional constants $\alpha$, $\beta$, $\gamma$ as described later on. In addition, the pressure receiving areas az, al, am are set such that the valve body 174 is held in an open position while the main valve 102 (103) and the pilot valve 120 (121) are being closed.

In the hydraulic drive system thus arranged, the pressure balance of the valve body 174 in the pressure compensating valve 172 (173) is expressed by the following equation:

$$az\ Pz = am\ Plmax + al\ Pl$$

Also, the pressure balance equation for the valve body 21 of the main valve 102 is expressed by:

$$Ac\ Pc = As\ Ps + Al\ Pl$$

From the above two equations, the differential pressure across the pilot valve 120 is give by:

$$Pc - Pz = \frac{As}{Ac}(Ps - Pl\max) + \left(\frac{As}{Ac} - \frac{am}{az}\right)(Pl\max - Pl) + \left(\frac{As}{Ac} - \frac{am}{az} + \frac{Al}{Ac} - \frac{al}{az}\right)Pl$$

Using the relationship of $Ac = As + Al$, this equation can be rewritten as follows:

$$Pc - Pz = \frac{As}{Ac}(Ps - Pl\max) + \left(\frac{As}{Ac} - \frac{am}{az}\right)(Pl\max - Pl) + \frac{1}{az}(az - am - al)Pl$$

Therefore, by substituting;

$$\alpha = \frac{As}{Ac}$$

$$\beta = \frac{As}{Ac} - \frac{am}{az}$$

$$\gamma = \frac{1}{az}(az - am - al)Pl$$

the above equation can now be expressed by:

$$Pc - Pz = \alpha(Ps - Plmax) + \beta(Plmax - Pl) + \gamma Pl \quad (5)$$

Assuming the differential pressure across the pilot valve 120 to be $\Delta Pz$, the left side is replaced by $\Delta Pz$ since $Pz - Pl = \Delta Pz$. Thus, there can be obtained the same equation as that derived in the foregoing embodiment.

Also in this embodiment, therefore, by setting the proportional constants $\alpha$, $\beta$, $\gamma$ to their predetermined values, the differential pressure $\Delta Pz$ across the pilot valve 120 can be controlled in proportion to three factors; the differential pressure Ps−Plmax between the delivery pressure Ps of the hydraulic pump 1 and the maximum load pressure Plmax, the differential pressure Plmax−Pl between the maximum load pressure Plmax and the self-load pressure Pl, and the self-load pressure Pl, respectively, thereby enabling to attain the pressure compensating and flow distributing function (first term in the right side), or the harmonizing function (second term in the right side) and/or the self-pressure compensating function (third term in the right side) in the combined operation based on the pressure compensating and flow distributing function, as mentioned above.

The self-load pressure Pl in the right side of the above equation (5) can be expressed using the inlet pressure Pc of the pilot valve 120 (=control pressure) and the delivery pressure Ps of the hydraulic pump based on the foregoing relationship of $Ac\ Pc = As\ Ps + Al\ Pl$. After all, the equation (5) can be expressed using four pressures; the inlet and outlet pressures Pc, Pz, the delivery pressure Ps of the hydraulic pump 1, and the maximum load pressure Plmax. Accordingly, this embodiment introduces three pressures, i.e., the outlet pressure Pz, the outlet pressure Pl of the main valve, and the maximum load pressure Plmax, rather than directly using the inlet and outlet pressures Pz, Pl of the pilot valve 120, the delivery pressure Ps of the hydraulic pump 1 and the maximum load pressure Plmax, in order to provide the same effect as attained using the latter four pressures Pz, Pl, Ps, Plmax.

As described above, the present invention is to control each pressure compensating valve based on four pressures, i.e., the inlet and outlet pressures of the pilot valve, the delivery pressure of the hydraulic pump 1, and the maximum load pressure, thereby making it possible to selectively achieve the pressure compensating and flow distributing function, or the harmonizing function and/or the self-pressure compensating function based on the pressure compensating and flow distributing function. These four pressures are related to each other via the control pressure Pc of the back pressure chamber 24, so the pressure compensating valve can also be controlled without direct use of all the four pressures. Further, the pressure compensating valve may be located either upstream or downstream of the pilot valve. Still other modifications in this respect will be explained below. Note that, in the following description, the main valve and the pilot valve are represented by 11, 15, respectively.

Figure 14:
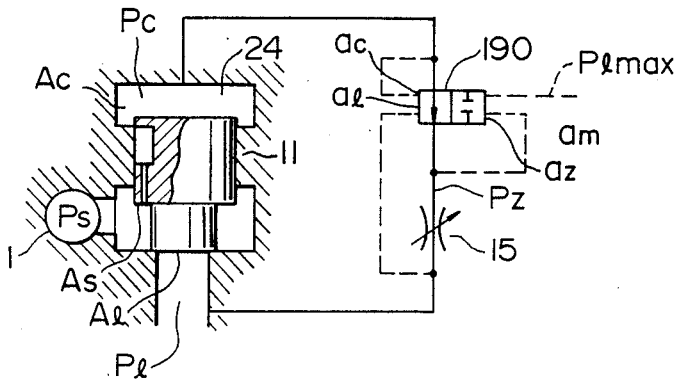
FIGS. 14 through 20 are schematic views showing respective flow control valves of hydraulic drive systems according to still other embodiments of the present invention.

FIG. 14 shows a modification in which a pressure compensating valve 190 is disposed in the pilot circuit between the back pressure chamber 24 and the pilot valve 15. The control pressure Pc of the back pressure chamber and the outlet pressure Pl of the pilot valve are introduced to the hydraulic control chambers having their pressure receiving areas ac, al and urging the pilot valve in the valve-opening direction, respectively, while the inlet pressure Pz of the pilot valve and the maximum load pressure Plmax are introduced to the hydraulic control chambers having their pressure receiving areas az, am and urging the pilot valve in the valve-closing direction, respectively.

The pressure balance of the pressure compensating valve 190 thus arranged is expressed by the following equation:

$$ac\ Pc + al\ Pl = am\ Plmax + az\ Pz$$

From this equation and the pressure balance equation for the main valve 11, the differential pressure across the pilot valve 15 can be derived as follows similarly to the foregoing embodiment:

$$Pz - Pl = \frac{as}{az}\ \frac{As}{Ac}(Ps - Pl\max) + \frac{1}{az}\left(ac\frac{As}{Ac} - am\right)(Pl\max - Pl) + \frac{1}{az}(ac + al - am - az)Pl$$

Therefore, by substituting three constants in the right side by $\alpha$, $\beta$, $\gamma$, respectively, the above equation is rewritten to:

$$Pz - Pl = \alpha(Ps - Plmax) + \beta(Plmax - Pl) + \gamma Pl \quad (6)$$

Figure 15:
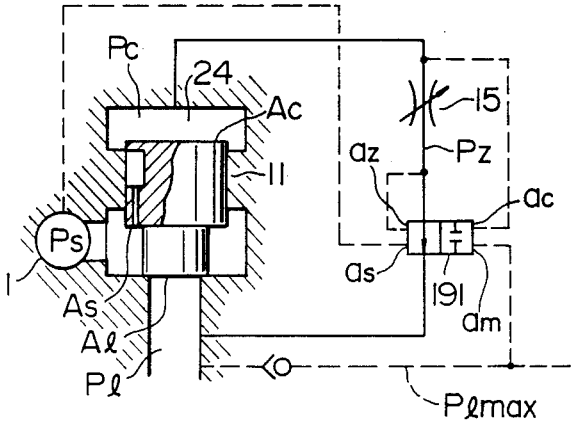

FIG. 15 shows a modification in which a pressure compensating valve 191 is disposed between the pilot valve 15 and the outlet port of the main valve 11. The delivery pressure Ps of the hydraulic pump 1 and the outlet pressure Pz of the pilot valve are introduced to the hydraulic control chambers having their pressure receiving areas as, az and urging the pilot valve in the valve-opening direction, respectively, while the inlet pressure Pc of the pilot valve and the maximum load pressure Plmax are introduced to the hydraulic control chambers having their pressure receiving areas ac, am and urging the pilot valve in the valve-closing direction, respectively.

The pressure balance of the pressure compensating valve 191 thus arranged is expressed by the following equation:

$$az\ Pz + as\ Ps = ac\ Pc + am\ Plmax$$

The equation representative of the differential pressure across the pilot valve 15 is given by:

$$Pc - Pz = \left\{\left(1 - \frac{ac}{az}\right)\frac{As}{Ac} + \frac{as}{az}\right\}(Ps - Pl\max) + \left\{\left(1 - \frac{ac}{az}\right)\frac{As}{Ac} + \frac{as}{az} - \frac{am}{az}\right\}(Pl\max - Pl) + \frac{1}{az}(az + as - ac - am)Pl$$

Therefore, by substituting three constants in the right side by $\alpha$, $\beta$, $\gamma$, respectively, the above equation is rewritten to:

$$Pc - Pz = \alpha(Ps - Plmax) + \beta(Plmax - Pl) + \gamma Pl \quad (7)$$

Figure 16:
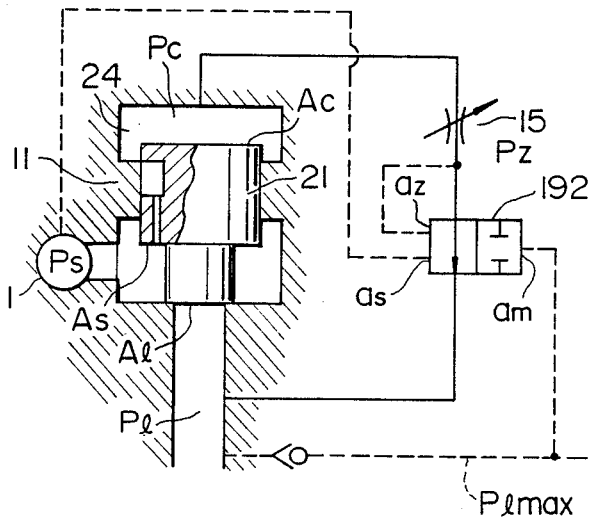

FIG. 16 shows a modification in which a pressure compensating valve 192 is disposed between the pilot valve 15 and the outlet port of the main valve 11. The delivery pressure Ps of the hydraulic pump 1 and the outlet pressure Pz of the pilot valve are introduced to the hydraulic control chambers having their pressure receiving areas as, az and urging the pilot valve in the valve-opening direction, respectively, while the maximum load pressure Plmax is introduced to the hydraulic control chamber having its pressure receiving areas am and urging the pilot valve in the valve-closing direction.

The pressure balance of the pressure compensating valve 192 thus arranged is expressed by the following equation:

$$az\ Pz + as\ Ps = am \cdot Plmax$$

The equation representative of the differential pressure across the pilot valve 15 is given by:

$$Pc - Pz = \left(\frac{As}{Ac} + \frac{as}{az}\right)(Ps - Pl\max) + \left(\frac{As}{Ac} + \frac{as}{az} - \frac{am}{az}\right)(Pl\max - Pl) + \frac{1}{az}(az + as - am)Pl$$

Therefore, by substituting three constants in the right side by $\alpha$, $\beta$, $\gamma$, respectively, the above equation is rewritten to:

$$Pc - Pz = \alpha(Ps - Plmax) + \beta(Plmax - Pl) + \gamma Pl \quad (8)$$

Figure 17:
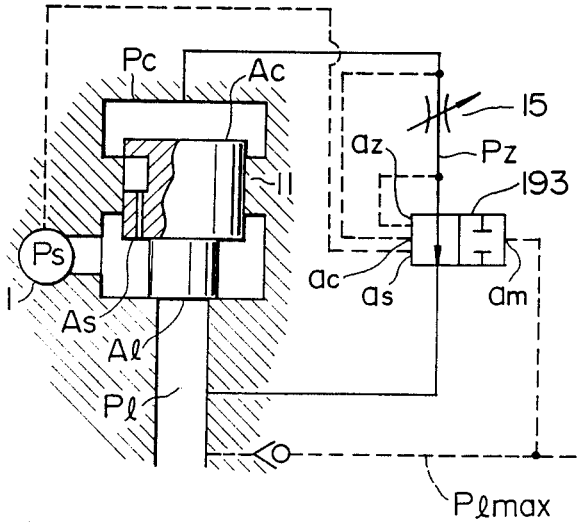

FIG. 17 shows a modification in which a pressure compensating valve 193 is disposed between the pilot valve 15 and the outlet port of the main valve 11. The delivery pressure Ps of the hydraulic pump 1, the inlet pressure Pc of the pilot valve and the outlet pressure Pz of the pilot valve are introduced to the hydraulic control chambers having their pressure receiving areas as, ac, az and urging the pilot valve in the valve-opening direction, respectively, while the maximum load pressure Plmax is introduced to the hydraulic control chamber having its pressure receiving area am and urging the pilot valve in the valve-closing direction.

The pressure balance of the pressure compensating valve 193 thus arranged is expressed by the following equation:

$$az\ Pz + ac\ Ac + as\ Ps = am\ Plmax$$

The equation representative of the differential pressure across the pilot valve 15 is given by:

$$Pc - Pz = \left\{\left(1 + \frac{ac}{az}\right)\frac{As}{Ac} + \frac{as}{az}\right\}(Ps - Pl\max) + \left\{\left(1 + \frac{ac}{az}\right)\frac{As}{Ac} + \frac{as}{az} - \frac{am}{az}\right\}(Pl\max - Pl) + \frac{1}{az}(az + as + ac - am)Pl$$

Therefore, by substituting three constants in the right side by $\alpha$, $\beta$, $\gamma$, respectively, the above equation is rewritten to:

$$Pc - Pz = \alpha(Ps - Plmax) + \beta(Plmax - Pl) + \gamma Pl \quad (9)$$

Figure 18:
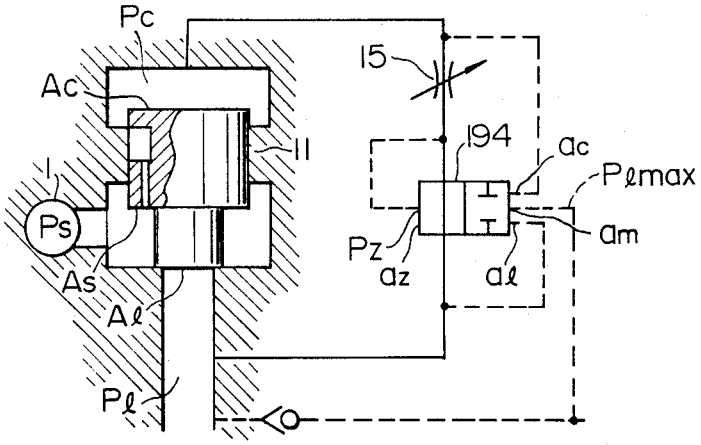

FIG. 18 shows a modification in which a pressure compensating valve 194 is disposed between the pilot valve 15 and the outlet port of the main valve 11. The outlet pressure Pz of the pilot valve is introduced to the hydraulic control chamber having its pressure receiving area az and urging the pilot valve in the valve-opening direction, while the inlet pressure Pc of the pilot valve, the outlet pressure Pl of the main valve 11 and the maximum load pressure Plmax are introduced to the hydraulic control chambers having their pressure receiving areas ac, al, am and urging the pilot valve in the valve-closing direction, respectively.

The pressure balance of the pressure compensating valve 194 thus arranged is expressed by the following equation:

$$az\ Pz = ac\ Ac + al\ Pl + am\ Plmax$$

The equation representative of the differential pressure across the pilot valve 15 is given by:

$$Pc - Pz = \left(1 - \frac{ac}{az}\right)\frac{As}{Ac}(Ps - Pl\max) + \left\{\left(1 - \frac{ac}{az}\right)\frac{As}{Ac} - \frac{am}{az}\right\}(Pl\max - Pl) + \frac{1}{az}(az - ac - am - al)Pl$$

Therefore, by substituting three constants in the right side by $\alpha,\beta,\gamma$, respectively, the above equation is rewritten to:

$$Pc - Pz = \alpha\ (Ps - Plmax) + \beta\ (Plmax - Pl) + \gamma\ Pl \quad (10)$$

Figure 19:
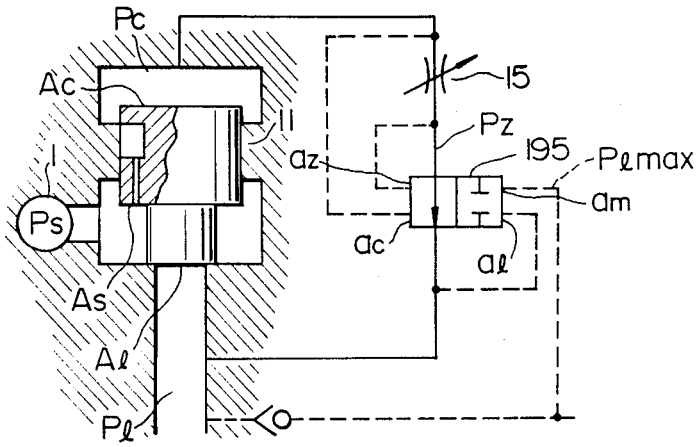

FIG. 19 shows a modification in which a pressure compensating valve 195 is disposed between the pilot valve 15 and the outlet port of the main valve 11. The inlet pressure Pc of the pilot valve and the outlet pressure Pz of the pilot valve are introduced to the hydraulic control chambers having their pressure receiving areas ac, az and urging the pilot valve in the valve-opening direction, while the outlet pressure Pl of the main valve 11 and the maximum load pressure Plmax are introduced to the hydraulic control chambers having their pressure receiving areas al, am and urging the pilot valve in the valve-closing direction, respectively.

The pressure balance of the pressure compensating valve 195 thus arranged is expressed by the following equation:

$$az\ Pz + ac\ Ac = al\ Pl + am\ Plmax$$

The equation representative of the differential pressure across the pilot valve 15 is given by:

$$Pc - Pz = \left(1 + \frac{ac}{az}\right)\frac{As}{Ac}(Ps - Pl\max) + \left\{\left(1 + \frac{ac}{az}\right)\frac{As}{Ac} - \frac{am}{az}\right\}(Pl\max - Pl) + \frac{1}{az}(az + ac - am - al)Pl$$

Therefore, by substituting three constants in the right side by $\alpha,\beta,\gamma$, respectively, the above equation is rewritten to:

$$Pc - Pz = \alpha\ (Ps - Plmax) + \beta\ (Plmax - Pl) + \gamma\ Pl \quad (11)$$

Figure 20:
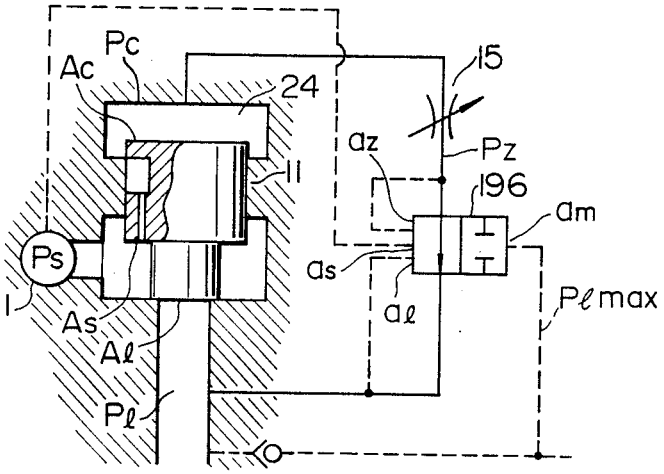

FIG. 20 shows a modification in which a pressure compensating valve 196 is disposed between the pilot valve 15 and the outlet port of the main valve 11. The outlet pressure Pz of the pilot valve, the delivery pressure Ps of the hydraulic pump 1, and the outlet pressure Pl of the main valve 11 are introduced to the hydraulic control chambers having their pressure receiving areas az, as, al and uring the pilot valve in the valve-opening direction, respectively, while the maximum load pressure Plmax is introduced to the hydraulic control chamber having its pressure receiving area am and urging the pilot valve in the valve-closing direction.

The pressure balance of the pressure compensating valve 196 thus arranged is expressed by the following equation:

$$az\ Pz + as\ Ps + al\ Pl = am\ Plmax$$

The equation representative of the differential pressure across the pilot valve 15 is given by:

$$Pc - Pz = \left(\frac{As}{Ac} + \frac{as}{az}\right)(Ps - Pl\max) + \left(\frac{As}{Ac} + \frac{as}{az} - \frac{am}{az}\right)(Pl\max - Pl) + \frac{1}{az}(az + as + al - am)Pl$$

Therefore, by substituting three constants in the right side by $\alpha,\beta,\gamma$, respectively, the above equation is rewritten to:

$$Pc - Pz = \alpha\ (Ps - Plmax) + \beta\ (Plmax - Pl) + \gamma\ Pl \quad (12)$$

OTHER EMBODIMENTS 2

One of still other embodiments of the present invention will be described below with reference to FIGS. 21 through 23. In these figures, identical members to those in the embodiment shown in FIG. 1 are designated at the same reference numerals.

Figure 22:
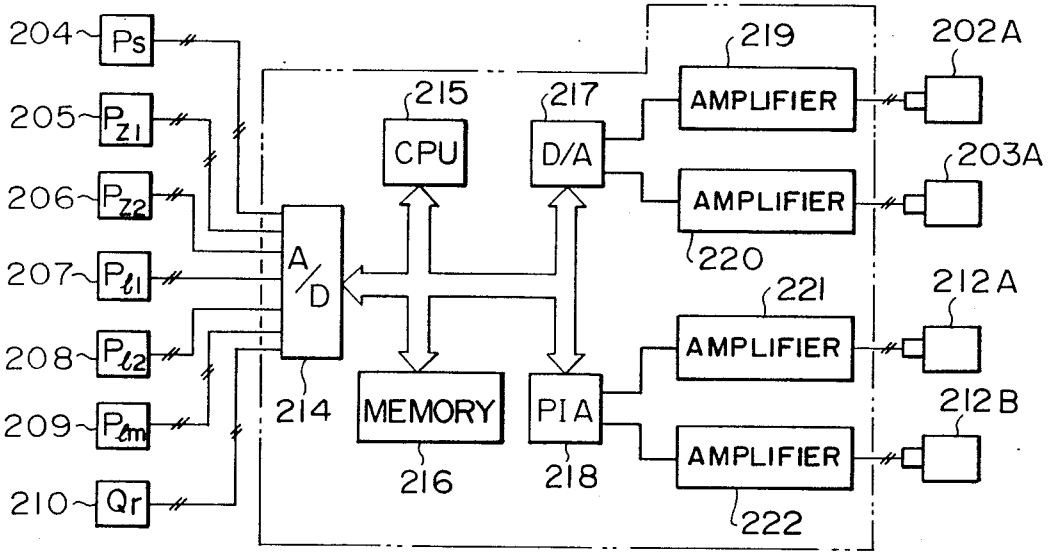
FIG. 22 is a schematic view showing an arrangement of a control unit of the hydraulic drive system of FIG. 21.
Figure 23:
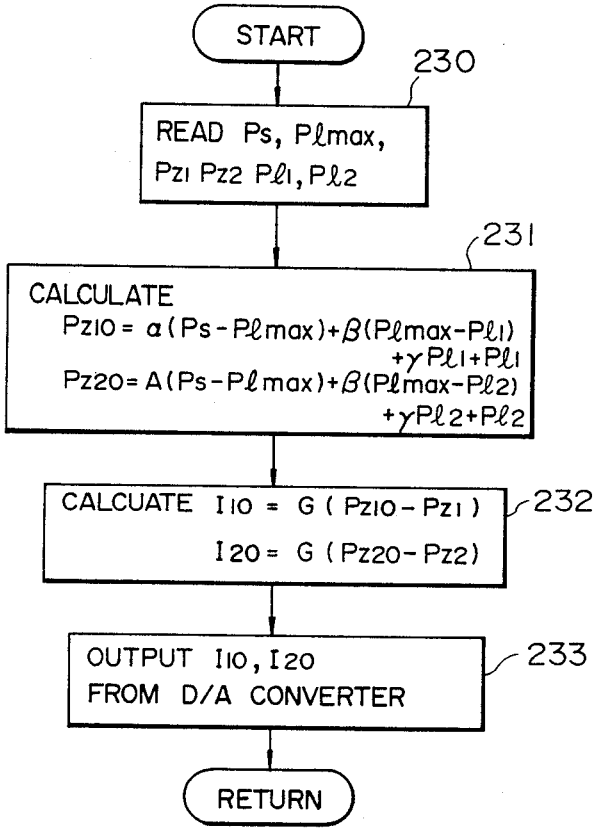
FIG. 23 is a flowchart showing the procedure of generating a control signal in the control unit.

In the foregoing embodiments, although the control means for the pressure compensating valve is constituted by hydraulic means which directly or indirectly introduces the delivery pressure of the hydraulic pump, the maximum load pressure, and the inlet and outlet pressures of the pilot valve to a plurality of hydraulic control chambers, that control means can also be constituted in an electrical manner. FIGS. 21 through 23 illustrate one of such embodiments.

Figure 21:
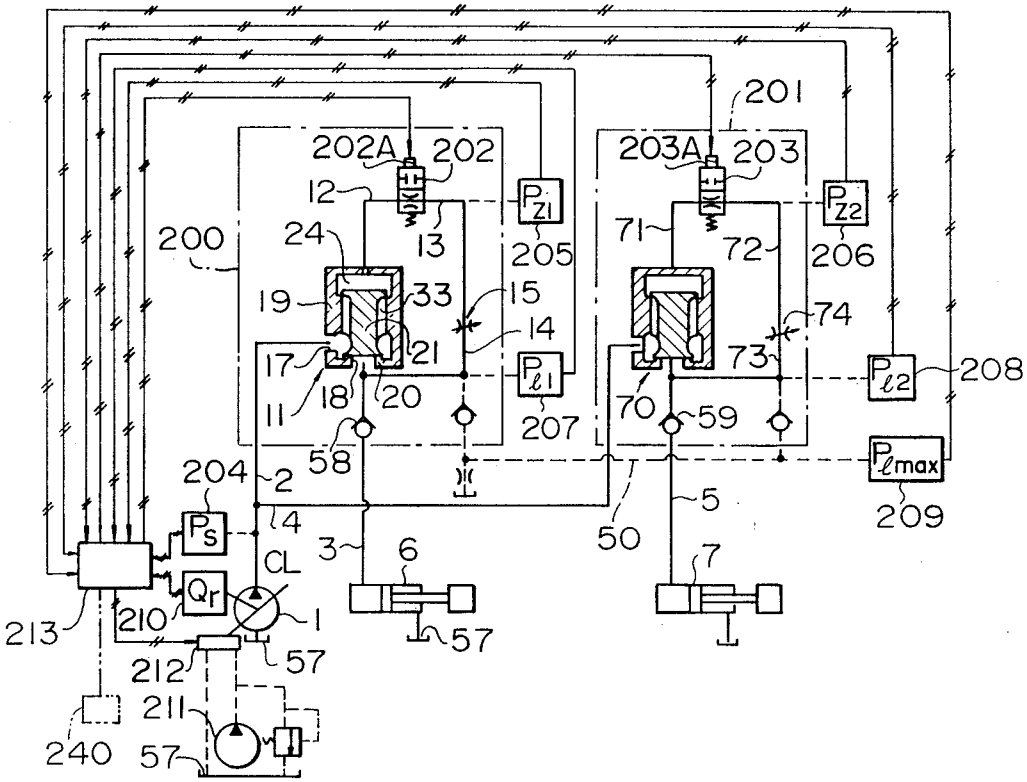
FIG. 21 is a schematic view showing an overall arrangement of a hydraulic drive system according to still another embodiment of the present invention.

More specifically, in FIG. 21, flow control valves for controlling hydraulic actuators 6, 7 are designated at reference numerals 200, 201, respectively. The flow control valves 200, 201 include pressure compensating valves 202, 203 comprising electromagnetic proportional valves 202, 203 having electromagnetic operating parts 202A, 203A, respectively. Except for this, each of the flow control valves 200, 201 is constructed in the same manner as the flow control valve 8, 9 in the embodiment of FIG. 1. A pressure detector 204 for detecting the delivery pressure Ps of a hydraulic pump 1 is connected to a delivery line of the hydraulic pump 1 in communication with main lines 2, 3, pressure detectors 205, 206 for detecting the inlet pressures Pz2 of pilot valves 15, 74 are connected to lines 13, 72 of the pilot circuit, respectively, pressure detectors 207, 208 for detecting the outlet pressures P1, P2 of the pilot valves 15, 74 are connected to pilot lines 14, 73, respectively, and a pressure detector 209 for detecting the maximum load pressure Plmax of the hydraulic actuators 6, 7 is connected to a maximum load pressure line 50. Further, the hydraulic pump 1 is associated with an angle gauge 210 for detecting a tilting angle of a swash plate, for example, which is used in a variable displacement mechanism. The delivery flow rate of the hydraulic pump 1 is controlled by a delivery flow control device 212 driven with hydraulic fluid from an auxiliary pump 211.

Pressure signals Ps Pz1, Pz2, Pl1, Pl2, Plmax from the pressure detectors 204–209 and a tilting angle signal Qr from the angle gauge 210 are input to a control unit 213 which calculates a control signal Qr Qo for the hydraulic pump 1 and control signals I1o, I2o for the pressure compensating valves 202, 203, and then output these signals to the delivery flow control device 212 and electromagnetic operating parts 202A, 203A of the pressure compensating valves, respectively.

The control unit 213 is constituted by a microcomputer and, as shown in FIG. 22, it comprises an A/D converter 214 for converting the above pressure signals and tilting angle signal to digital signals, a central processing unit 215, a memory 216 for storing the program of control procedure, a D/A converter 217 for outputting analog signals, an I/O interface 218, amplifiers 219, 220 connected to the electromagnetic operating parts 202A, 203A of the respective pressure compensating valves, and amplifiers 221, 222 connected to input terminals 212A, 212B of the delivery amount control device 212, respectively.

The control unit 213 calculates a delivery flow target value Qr of the hydraulic pump 1 which is effective to hold the pump delivery pressure higher a predetermined value than the maximum load pressure, using the pressure signal Ps from the pressure detector 204 for detecting the delivery pressure of the hydraulic pump 1 and the pressure signal Plmax from the pressure detector 209 for detecting the maximum load pressure between the hydraulic actuators 6, 7 on the basis of the control procedure program stored in the memory 216. The target value signal Qr is output from the amplifiers 221, 222 to the input terminals 212A, 212B of the delivery flow control device 212 through the I/O interface 218. In response to receipt of the target value signal Qr, the delivery flow control device 212 controls a tilting angle of the swash plate of the hydraulic pump 1 so that the tilting angle Qr detected by the angle gauge 210 becomes equal to the target value Qr. This holds the pump delivery pressure higher a predetermined value than the maximum load pressure, thereby providing a similar function to the hydraulic pump regulator of load sensing type used in the foregoing embodiments.

The control unit 213 also calculates control amounts of the pressure compensating valves 202, 203 based on the pressure signals Ps, Pz1, Pz2, Pl1, Pl2, Plmax from the pressure detectors 204–209 for controlling the pressure compensating valves. FIG. 23 is a flowchart showing the control procedure of the pressure compensating valves. In step 230, the microcomputer reads in the pressure signals Ps, Pz1, Pz2, Pl1, Pl2, Plmax detected by the pressure detectors 204–209. Then, in step 231, target inlet pressures Pz10, Pz20 of the pilot valves 15, 74 are calculated from the following equations:

$$Pz10=\alpha\ (Ps-Plmax)+\beta\ (Plmax-Pl1)+\gamma\ Pl1+Pl1$$

$$Pz20=\alpha\ (Ps-Plmax)+\beta\ (Plmax-Pl2)+\gamma\ Pl2+Pl2$$

It is to be noted that these equations are identical to the equation (1) in the first embodiment, and constants $\alpha,\beta,\gamma$ are set to their predetermined values as shown in FIGS. 5 through 7, for example, depending on selection of three functions, i.e., the pressure compensating and flow distributing function, the harmonizing function, and the self-pressure compensating function. In next step 232, the following equations;

$$I1o=G\ (Pz10-Pz1)$$

$$I2o=G\ (Pz20-Pz2)$$

are calculated to obtain control signals I1o, I2o for the pressure compensating valves 202, 203. In final step 233, the calculated control signals I1o, I2o are output from the amplifiers 219, 220 to the electromagnetic operating parts 202A, 203A of the pressure compensating valves 202, 203 through the D/A converter 217, respectively.

Thus, also in this embodiment where the pressure compensating valves 202, 203 are electrically controlled, by presetting the equations shown in the step 231 and identical to the above-mentioned equation (1) in the program, it becomes possible to perform the pressure compensating and flow distributing function, or the harmonizing function and/or self-pressure compensating function based on the pressure compensating and flow distributing function, depending on the respective setting values of the constants $\alpha,\beta,\gamma$ in a like manner to the embodiment shown in FIG. 1.

In the above embodiment where the pressure compensating valves are controlled electrically, the constants $\alpha,\beta,\gamma$ are preset as a part of the program. Alternatively, a regulator 240 operable from the exterior may be connected to the control unit 213 as indicated by the imaginary line in FIG. 21, so that the constants $\alpha,\beta,\gamma$ may variably be set depending on the types of hydraulic construction machines and the working members thereof, etc.

Figure 24:
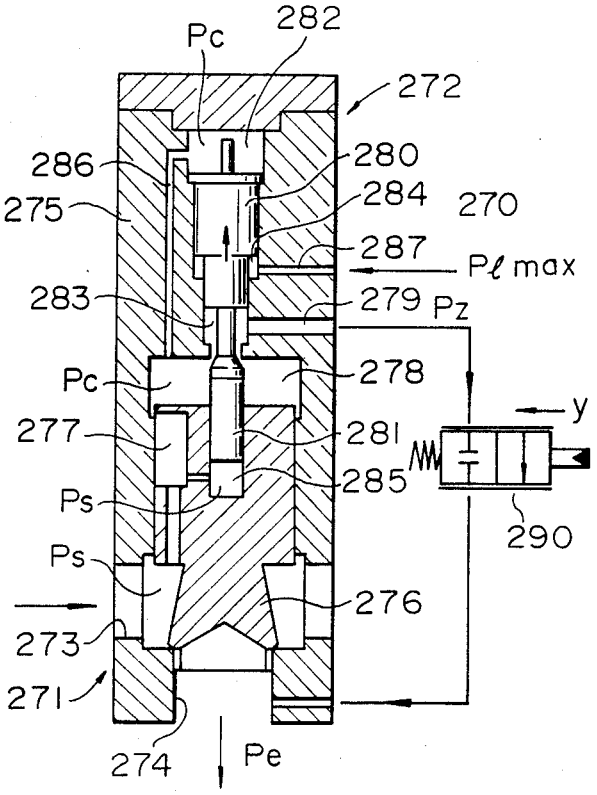
FIG. 24 is a sectional view showing an embodiment in which a main valve and a pressure compensating valve of the flow control valve for use in the hydraulic drive system of the present invention are incorporated into an integral structure.

One embodiment of the present invention relating to the valve structure will be described below with reference to FIG. 24. FIG. 24 shows an embodiment in which the seat type main valve and the pressure compensating valve of the flow control valve are incorporated into an integral structure.

More specifically, in FIG. 24, a flow control valve 270 comprises a main valve section 271 and a pressure compensating valve section 272. The main valve section 271 is disposed in a valve housing 275 having an inlet port 273 and an output port 274, and has a valve body 276 of seat valve type for controlling communication between the inlet port 273 and the outlet port 274. The valve body 276 has formed in its circumference a passage 277 which constitutes a variable restrictor, and a back pressure chamber 278 communicating with the inlet port 273 through the variable restrictor 277 is defined at the back of the valve body 276. The pressure compensating valve section 272 has a valve body 280 of spool type disposed in the valve housing 275 for restricting the passage between the back pressure chamber 278 and a pilot outlet port 279. The valve body 280 is engaged with a piston 281 inserted in the valve body 276 of the main valve movably in the axial direction. The pressure compensating valve section 272 also comprises a first hydraulic control chamber 282 in facing relation to the end surface of the valve body 280 opposite to the piston, a second hydraulic control chamber 283 in facing relation to the first annular end surface of the valve body 280, a third hydraulic control chamber 284 in facing relation to the second annular end surface of the valve body 280, and a fourth hydraulic control chamber 285 defined in the valve body 276 of the main valve in facing relation to the end surface of the piston 281. The first hydraulic control chamber 282 is communicated with the back pressure chamber 278 through a passage 286, the second hydraulic control chamber 283 is communicated with a pilot outlet port 279, the third hydraulic control chamber 284 is communicated with a maximum load pressure port 287, and the fourth hydraulic control chamber 285 is communicated with the inlet port 273 of the main valve through a passage. The pilot outlet port 279 is connected to a pilot valve 290 through a pilot line, and the maximum load pressure port 287 is connected to a maximum load pressure line (not shown). With the above arrangement, introduced into the first through fourth hydraulic control chambers are a control pressure Pc of the back pressure chamber 278, an inlet pressure Pz of the pilot valve 290, a maximum load pressure Plmax, and a delivery pressure Ps of a hydraulic pump, respectively. As will be seen, the first through fourth hydraulic control chambers 282–285 correspond to the first through fourth hydraulic control chambers 131–134 of the flow control valve shown in FIG. 9, respectively.

Thus, the compact and rational valve structure can be obtained by combining the main valve and the pressure compensating valve into an integral structure.

Figure 25:
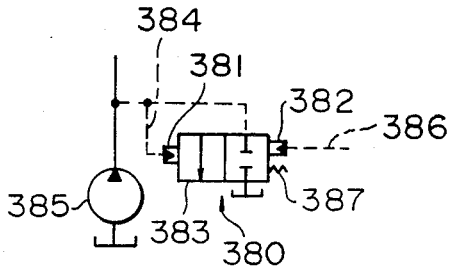
FIG. 25 is a circuit diagram showing an embodiment of a pump regulator of load sensing type where a fixed displacement pump is used in the hydraulic drive system of the present invention.

Another embodiment of the present invention relating to the pump control means will be described below. In the foregoing embodiment, the hydraulic drive system was described in combination with the pump regulator of load sensing type, and the pump regulator of load sensing type was described as an implement to control the delivery pressure of the variable displacement hydraulic pump. But the hydraulic pump may be of a fixed displacement type. In this case, the pump regulator of load sensing type is constructed as shown in FIG. 25. More specifically, in FIG. 25, a pump regulator 380 is associated with a relief valve 383 having pilot chambers 381, 382 positioned opposite to each other. The delivery pressure of a fixed displacement hydraulic pump 385 is introduced to the pilot chamber 381 through a pilot line 384 and the maximum load pressure is introduced to the pilot chamber 382 through a pilot line 386, with a spring 387 disposed on the same side as the pilot chamber 382. This arrangement enables to hold the delivery pressure of the hydraulic pump 385 higher than the maximum load pressure among a plurality of hydraulic actuators by a pressure value corresponding to the resilient strength of the spring 387.

Figure 26:
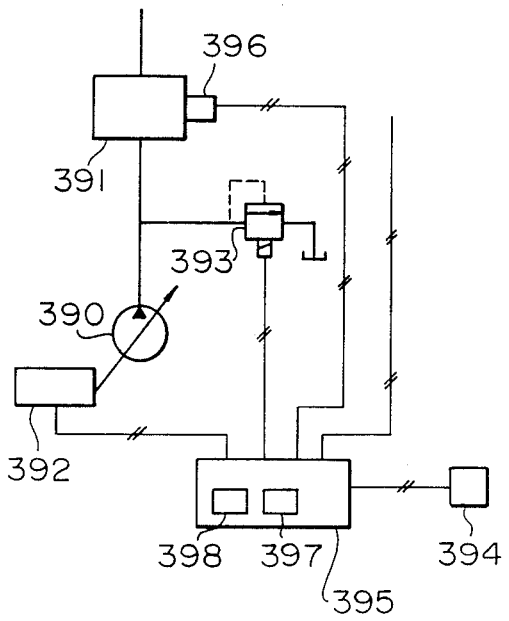
FIG. 26 is a circuit diagram showing an embodiment of pump control means of not load sensing type which is used in the hydraulic drive system of the present invention.

Further, the hydraulic drive system of the present invention may be made up in combination with a pump regulator other than load sensing type. FIG. 26 shows such a modification. More specifically, in FIG. 26, a hydraulic pump 390 is connected to a flow control valve 391 consisted of a main valve, a pilot valve and a pressure compensating valve which are combined as mentioned above, and produces a delivery flow rate adjusted by a pump flow control device 392. An unloading valve 393 is connected between the hydraulic pump 390 and the flow control valve 391, and the flow control valve 391 is associated with an operation device 394. An operated signal from the operation device 394 is sent to a control device 395 which applies a control signal to a pilot valve driver part 396 of the flow control valve 391 for controlling the opening degree of the pilot valve. The operated signal sent to the control device 395 is also applied to a processing device 397 which calculates a required flow rate of the flow control valve 391 from the map previously stored in a storage device 398, and then sends a calculated signal to the pump flow control device 392. At the same time, the processing device 397 calculates a setting pressure of the unloading valve 393 from another map previously stored in the storage device 398, and then sends a calculated signal to the unloading valve 393. This allows the delivery pressure of the hydraulic pump 390 to be controlled equal to a pressure obtained from the map previously stored in the storage device 398 as a function of the operated signal.

In the hydraulic drive system of the present invention combined with such pump control means, the differential pressure Ps−Plmax represented by the first term in the right side of the foregoing equation (1) cannot be controlled to be constant. Therefore, the pressure compensating function obtainable with the first term in the right side cannot be achieved. In the combined operation, however, that differential pressure remains common to all of the flow control valves associated with the respective hydraulic actuators, so the flow distributing function can still be achieved. Further, since the second and third terms in the right side of the equation (1) are not related to the pump delivery pressure Ps, the harmonizing function and/or the self-pressure compensating function based on the flow distributing function can be achieved in case of setting $\beta,\gamma$ to any values other than zero.

Although the embodiments of the present invention have been described with reference to the drawings, the present invention is not limited to the particular embodiments mentioned above, and can be subject to various other modifications and changes without departing from the spirit and scope of the invention.

For example, although the foregoing embodiments were illustrated as driving two hydraulic actuators by a hydraulic pump, it is a matter of course that the present invention is also applicable to the case of using three or more hydraulic actuators. Also, the pump control means may be associated with a simple relief valve for holding the delivery pressure of the hydraulic pump at constant.

What is claimed is:

1. A hydraulic drive system comprising: at least one hydraulic pump; at least first and second hydraulic actuators connected to said hydraulic pump through respective main circuits and driven by hydraulic fluid delivered from said hydraulic pump; first and second flow control valve means connected to said respective main circuits between said hydraulic pump and said first and second hydraulic actuators; pump control means for controlling a delivery pressure of said hydraulic pump; each of said first and second flow control valve means comprising first valve means having an opening degree variable in response to the operated amount of operation means, and second valve means connected in series with said first valve means for controlling a differential pressure between the inlet pressure and the output pressure of said first valve means; and control means associated with each of said first and second flow control valve means for controlling said second valve means based on the input pressure and the output pressure of said first valve means, the delivery pressure of said hydraulic pump, and the maximum load pressure between said first and second hydraulic actuators, wherein:

each of said first and second flow control valve means comprises: a main valve of seat valve type having a valve body for controlling communication between an inlet port and an outlet port both connected to said main circuit, a variable restrictor capable of changing an opening degree thereof in response to displacements of said valve body, and a back pressure chamber communicating with said inlet port through said variable restrictor and producing a control pressure to urge said valve body in the valve-closing direction; and a pilot circuit connected between said back pressure chamber and said outlet port of said main valve;

said first valve means is a pilot valve connected to said pilot circuit for controlling a pilot flow passing through said pilot circuit, and said second valve means is an auxiliary valve means connected to said pilot circuit for controlling a differential pressure between the inlet pressure and the outlet pressure of said pilot valve; and said control means controls said auxiliary valve means for each of said first and second flow control valve means such that the differential pressure between the inlet pressure and the outlet pressure of said pilot valve has a relationship expressed by the following equation with respect to a differential pressure between the delivery pressure of said hydraulic pump and the maximum load pressure of said first and second hydraulic actuators, a differential pressure between said maximum load pressure and the self-load pressure of each said hydraulic actuator, and the self-load pressure, $$\Delta Pz = \alpha\,(Ps - Pl\max) + \beta\,(Pl\max - Pl) + \gamma\,Pl$$

where $\Delta Pz$: differential pressure between the inlet pressure and the outlet pressure of the pilot valve Ps: delivery pressure of the hydraulic pump Plmax: maximum load pressure between the first and second hydraulic actuators Pl: self-load pressure of each of the first and second hydraulic actuators $\alpha,\beta,\gamma$: first, second and third constants said first, second and third constants $\alpha,\beta,\gamma$ being set to respective predetermined values.

2. A hydraulic drive system according to claim 1, wherein said first constant $\alpha$ has a relationship of $\alpha \leqq K$ assuming that K is a ratio of the pressure receiving area of the valve body of said main valve undergoing the delivery pressure of said hydraulic pump through said inlet port to the pressure receiving area of the valve body of said main valve undergoing the control pressure of said back pressure chamber.

3. A hydraulic drive system according to claim 2, wherein said second and third constants $\beta,\gamma$ are set to zero.

4. A hydraulic drive system according to claim 1, wherein said first constant $\alpha$ is set to any desired positive value corresponding to the proportional gain of a main flow rate of said main valve with respect to the operated amount of said operation means.

5. A hydraulic drive system according to claim 1, wherein said second constant $\beta$ is set to any desired value based on harmonization of the combined operation of the associated hydraulic actuator and one or more other hydraulic actuators.

6. A hydraulic drive system according to claim 1, wherein said third constant $\gamma$ is set to any desired value based on operating characteristics of the associated hydraulic actuator.

7. A hydraulic drive system according to claim 1, wherein said control means has a plurality of hydraulic control chambers provided in each of said auxiliary valves for said first and second flow control valve means, and line means for directly or indirectly introducing the delivery pressure of said hydraulic pump, said maximum load pressure, and the inlet pressure and the outlet pressure of said pilot valve to said plurality of hydraulic control chambers, the respective pressure receiving areas of said plurality of hydraulic control chambers being set such that said first, second and third constants $\alpha,\beta,\gamma$ become equal to said respective predetermined values.

8. A hydraulic drive system according to claim 7, wherein said auxiliary valve is disposed between the back pressure chamber of said main valve and said pilot valve, said plurality of hydraulic control chambers comprise a first hydraulic control chamber for urging said auxiliary valve in the valve-opening direction, and second, third and fourth hydraulic control chambers for urging said auxiliary valve in the valve-closing direction, and said line means comprises a first line for introducing the control pressure in the back pressure of said main valve to said first hydraulic chamber, a second line for introducing the inlet pressure of said pilot valve to said second hydraulic control chamber, a third line for introducing said maximum load pressure to said third hydraulic control chamber, and a fourth line for introducing the delivery pressure of said hydraulic pump to said fourth hydraulic control chamber.

9. A hydraulic drive system according to claim 8, wherein said first and second flow control valves are each constituted by incorporating said main valve and said auxiliary valve into an integral structure.

10. A hydraulic drive system according to claim 1, wherein said control means comprises electromagnetic operating parts provided in each of said auxiliary valve means for said first and second flow control valves, pressure detector means for directly or indirectly detecting the delivery pressure of said hydraulic pump, said maximum load pressure, and the inlet pressure and the outlet pressure of said pilot valve, and processing means for computing a differential pressure between the inlet pressure and the outlet pressure of said pilot valve based on detected signals from said pressure detector means, and then outputting a computed differential pressure signal to the electromagnetic operating parts of said auxiliary valve means, and wherein said first, second and third constants $\alpha,\beta,\gamma$ are preset as said respective predetermined values in said processing means.

11. A hydraulic drive system according to claim 1, wherein said pump control means is a pump regulator of load sensing type for holding the delivery pressure of said hydraulic pump higher a predetermined value than the maximum load pressure between said first and second hydraulic actuators.

12. A hydraulic excavator comprising: at least one hydraulic pump; a plurality of hydraulic actuators connected to said hydraulic pump through respective main circuits and driven by hydraulic fluid delivered from said hydraulic pump; a plurality of working members including a swing body, boom, arm and bucket, and driven by said plurality of hydraulic actuators, respectively; a plurality of flow control valve means connected to said respective main circuits between said hydraulic pump and said plurality of hydraulic actuators; pump control means for controlling a delivery pressure of said hydraulic pump; each of said plurality of flow control valve means comprising first valve means having an opening degree variable in response to the operated amount of operation means, and second valve means connected in series with said first valve means for controlling a differential pressure between the inlet pressure and the output pressure of said first valve means; and control means associated with each of said plurality of flow control valve means for controlling said second valve means based on the input pressure and the output pressure of said first valve means, the delivery pressure of said hydraulic pump, and the maximum load pressure among said plurality of hydraulic actuators, wherein:

each of said plurality of flow control valve means comprises: a main valve of seat valve type having a valve body for controlling communication between an inlet port and an outlet port both connected to said main circuit, a variable restrictor capable of changing an opening degree thereof in response to displacements of said valve body, and a back pressure chamber communicating with said inlet port through said variable restrictor and producing a control pressure to urge said valve body in the valve-closing direction; and a pilot circuit connected between said back pressure chamber and said outlet port of said main valve;

said first valve means is a pilot valve connected to said pilot circuit for controlling a pilot flow passing through said pilot circuit, and said second valve means is constituted by auxiliary valve means connected to said pilot circuit for controlling a differential pressure between the inlet pressure and the outlet pressure of said pilot valve; and said control means controls said auxiliary valve means for each of said plurality of flow control valve means associated with at least two working members among said swing body, boom, arm and bucket such that the differential pressure between the inlet pressure and the outlet pressure of said pilot valve has a relationship expressed by the following equation with respect to a differential pressure between the delivery pressure of said hydraulic pump and the maximum load pressure among said plurality of hydraulic actuators, a differential pressure between said maximum load pressure and the self-load pressure of each of said hydraulic actuators, and the self-load pressure, $$\Delta Pz=\alpha\ (Ps-Pl\max)+\beta\ (Pl\max-Pl)+\gamma\ Pl$$

where $\Delta$Pz: differential pressure between the inlet pressure and the outlet pressure of the pilot valve Ps: delivery pressure of the hydraulic pump Plmax: maximum load pressure among the plurality of hydraulic actuators Pl: self-load pressure of each of the plurality of hydraulic actuators $\alpha,\beta,\gamma$: first, second and third constants said first, second and third constants $\alpha,\beta,\gamma$ being set to respective predetermined values.

13. A hydraulic drive system according to claim 12, wherein said first constant $\alpha$ meets a relationship of $\alpha \leqq K$, assuming that K is a ratio of the pressure receiving area of the valve body of said main valve undergoing the delivery pressure of said hydraulic pump through said inlet port to the pressure receiving area of the valve body of said main valve undergoing the control pressure of said back pressure chamber.

14. A hydraulic excavator according to claim 12, wherein said control means sets said second constant $\beta$ to a relatively large positive value for the flow control valve means associated with the bottom side of said hydraulic actuator for said boom.

15. A hydraulic excavator according to claim 12, wherein said control means sets said second constant $\beta$ to a relatively small positive value for the flow control valve means associated with the bottom side of said hydraulic actuator for said arm.

16. A hydraulic excavator according to claim 12, wherein said control means sets said second constant $\beta$ to a relatively small negative value for the flow control valve means associated with the bottom side of said hydraulic actuator for said bucket.

17. A hydraulic excavator according to claim 12, wherein said control means sets said third constant $\gamma$ to a relatively small negative value for the flow control valve means associated with the hydraulic actuator for said swing body.

18. A hydraulic excavator according to claim 12, wherein said control means sets said third constant $\gamma$ to a relatively small positive value for the flow control valve means associated with the hydraulic actuator for said bucket.

19. A hydraulic excavator according to claim 12, wherein said control means sets said second and third constants $\beta,\gamma$ to zero for the flow control valve means associated with the rod side of said hydraulic actuators for said boom and arm.

* * * * *